US006892679B2

(12) United States Patent
Jameel et al.

(10) Patent No.: US 6,892,679 B2
(45) Date of Patent: May 17, 2005

(54) MULTI-MEDIA ROTATING SOOTBLOWER AND AUTOMATIC INDUSTRIAL BOILER CLEANING SYSTEM

(75) Inventors: Mohomed Ishag Jameel, Lawrenceville, GA (US); Bruce Townsend, Flowery Branch, GA (US); Hans Schwade, Atlanta, GA (US)

(73) Assignee: Clyde Bergemann, Inc., Atlanta, GA (US)

( * ) Notice: Subject to any disclaimer, the term of this patent is extended or adjusted under 35 U.S.C. 154(b) by 139 days.

(21) Appl. No.: 10/612,245

(22) Filed: Jul. 2, 2003

(65) Prior Publication Data

US 2004/0006841 A1 Jan. 15, 2004

Related U.S. Application Data

(60) Provisional application No. 60/394,599, filed on Jul. 9, 2002.

(51) Int. Cl.[7] ..... F22B 37/48

(52) U.S. Cl. ..... 122/379; 122/380; 122/405; 15/316.1

(58) Field of Search ..... 134/167 C, 171, 134/113, 56 R, 167 R; 122/379, 380, 390, 396, 405; 15/315, 316.1

(56) References Cited

U.S. PATENT DOCUMENTS

| | | | | |
|---|---|---|---|---|
| 4,422,882 A | * | 12/1983 | Nelson et al. | 134/22.18 |
| 5,096,502 A | * | 3/1992 | Carter et al. | 134/18 |
| 5,416,946 A | * | 5/1995 | Brown et al. | 15/318 |
| 5,437,295 A | | 8/1995 | Brown et al. | |
| 5,509,607 A | * | 4/1996 | Booher et al. | 239/289 |
| 5,579,726 A | * | 12/1996 | Finucane | 122/379 |
| 5,619,771 A | | 4/1997 | Minic | |
| 5,778,831 A | | 7/1998 | Jameel | |
| 5,836,268 A | | 11/1998 | Wall | |
| 6,323,442 B1 | | 11/2001 | Jones | |
| 6,325,025 B1 | * | 12/2001 | Perrone | 122/379 |
| 6,425,352 B2 | | 7/2002 | Perrone | |

FOREIGN PATENT DOCUMENTS

| | | |
|---|---|---|
| GB | 762323 | 11/1956 |
| GB | 921392 | 3/1963 |
| GB | 1029668 | 5/1966 |

* cited by examiner

*Primary Examiner*—Gregory A. Wilson
(74) *Attorney, Agent, or Firm*—Michael J. Mehrman; Mehrman Law Office

(57) ABSTRACT

A multi-media rotating sootblower that includes multiple rotating and individually controlled cleaning fluid applicators, such a set of steam nozzles and two sets of water nozzles, and an automatic boiler cleaning system using these sootblowers. The boiler superheater typically includes a system of these sootblowers to clean a number of large platens that are arranged in rows. The boiler may also include additional boiler cleaning equipment, including water cannons to clean the furnace, and conventional steam sootblowers to clean other heat exchangers of the boiler. A number of sensors, including heat transfer gauges that measure the heat transfer at the furnace wall, strain gauges that measure the weight of slag deposits on platens, and boiler cameras are used to monitor slag accumulations within the boiler. A control system uses this sensor data to automatically operate the boiler cleaning system to implement an automatic boiler cleaning regimen.

36 Claims, 31 Drawing Sheets

(LEGEND FOR FIG. 4A)

(BOILER SIDE VIEW)

(BOILER TOP VIEW)

(BOILER TOP VIEW)

MULTI-MEDIA ROTATING SOOTBLOWER AND AUTOMATIC INDUSTRIAL BOILER CLEANING SYSTEM

REFERENCE TO RELATED APPLICATIONS

This application claims priority to commonly-owned U.S. Provisional Patent Application Ser. No. 60/394,599, entitled "Long Retractable Rotating Multi Media Sootblower," filed on Jul. 9, 2002.

TECHNICAL FIELD

The present invention relates to sootblowers used to clean industrial boilers and, more particularly, relates to a multi-media rotating sootblower that includes multiple rotating and individually controlled cleaning fluid applicators, such a set of steam nozzles and two sets of water nozzles, and an automatic boiler cleaning system using these sootblowers.

BACKGROUND OF THE INVENTION

Industrial boilers, such as oil-fired, coal-fired and trash-fired boilers in power plants used for electricity generation and waste incineration, as well as boilers used in paper manufacturing, oil refining, steel and aluminum smelting and other industrial enterprises, are huge structures that generate tons of ash while operating at very high combustion temperatures. These boilers are generally characterized by an enormous open furnace in a lower section of the boiler housed within walls constructed from heat exchanger tubes that carry pressurized water, which is heated by the furnace. An ash collection and disposal section is typically located below the furnace, which collects and removes the ash for disposal, typically using a hopper to collect the ash and a conveyor or rail car to transport it away for disposal.

A superheater section is typically located directly above the furnace, which includes a number of panels, also called platens or pendants, constructed from heat exchanger tubes that hang from the boiler roof, suspended above the combustion zone within the furnace. The superheater platens typically contain superheated steam that is heated by the furnace gas before the steam is transported to steam-driven equipment located outside the boiler, such as steam turbines or wood pulp cookers. The superheater is exposed to very high temperatures in the boiler, such as about 2800 degrees Fahrenheit [about 1500 degrees Celsius], because it is positioned directly above the combustion zone for the purpose of exchanging the heat generated by the furnace into the steam carried by the platens. The boiler also includes a number of other heat exchangers that are not located directly above the furnace, and for this reason operate at lower temperatures, such as about 1000–1500 degrees Fahrenheit [about 500–750 degrees Celsius]. These boiler sections may be referred to as a convection zone typically including one or more pre-heaters, re-heaters, superheaters, and economizers.

There is a high demand for thermal energy produced by these large industrial boilers, and they exhibit a high cost associated with shutting down and subsequently bringing the boilers back up to operating temperatures. For these reasons, the boilers preferably run continuously for long periods of time, such as months, between shut down periods. This means that large amounts of ash, which is continuously generated by the boiler, must be removed while the boiler remains in operation. Further, fly ash tends to adhere and solidify into slag that accumulates on high-temperature interior boiler structures, including the furnace walls, the superheater platens, and the other heat exchangers of the boiler. If the slag is not effectively removed while the boiler remains in operation, it can accumulate to such an extent that it significantly reduces the heat transfer capability of the boiler, which reduces the thermal output and economic value of the boiler. In addition, large unchecked accumulations of slag can cause huge chunks of slag to break loose, particularly from the platens, which fall through the boiler and can cause catastrophic damage and failure of the boiler.

The slag accumulation problem in many conventional boilers has been exacerbated in recent years by increasingly stringent air quality standards, which have mandated a change to coal with a lower sulphur content. This low-sulphur coal has a higher ash content and produces more tenacious slag deposits that accumulate more quickly and are more difficult to remove, particularly from the superheater platens. To combat this problem, the industry has developed increasingly sophisticated boiler cleaning equipment that operates continually while the boiler remains in operation. In particular, water cannons can be periodically used to clean the boiler walls in the open furnace section, and conventional steam sootblowers can be used to clean the heat exchangers. These steam sootblowers generally include lance tubes that are inserted into the boiler adjacent to the heat exchangers and operate like large pressure washers to clean the heat exchangers with steam blasts while the boiler remains in operation.

Conventional steam sootblowers have included rotating lance tubes that blast the steam in a corkscrew pattern to clean as wide an area as possible as the lance advances. In these superheaters, the platens are typically arranged in rows of panels, and therefore require a system of sootblowers that travel among and clean the various platens. However, slag deposits in some boiler superheaters have proven to be so tenacious that this type of steam cleaning is insufficient. For areas with slag deposits that resist steam cleaning, sootblowers that use water as the cleaning medium have been employed. A difficulty arises with the use of water as a cleaning fluid because the thermal shock imposed on the heat exchanger tubes is much greater when water is used as the cleaning fluid. Eventually, water shock can cause the heat exchanger tubes to crack and fail, which requires a major boiler renovation.

Water stress is such a serious issue that water cleaning should be kept to a minimum to avoid unnecessarily shortening the boiler's life. Furthermore, water cleaning tends to cause slag to be removed from the platens in fairly large sections, as the water penetrates the slang and flashes to steam, which blows chunks of slag away from the platen. Once a large chunk of slag has been removed, it is important that the now bare platen tubes not be shocked with subsequent water streams. It is also important that water cleaning, unlike steam, not be applied too close to the heat exchanger tubes to avoid cracking the tubes during the cleaning process.

The boiler cleaning problems described above have led to the proliferation of sootblowers, particularly in the superheater areas of boilers, because steam sootblowers are desirable for regularly-scheduled cleaning passes, whereas more closely controlled water sootblowers are desirable for occasional rigorous cleaning of areas encrusted with tenacious slag that resists steam cleaning. This dual-media cleaning need has led to the advent of dual-media sootblowers that have attempted to effectively deliver both steam and water as cleaning fluids. However, the objective of delivering both steam and water through a single lance has proved difficult to attain because water lances are typically tethered to water hoses, whereas steam lances rotate feely. In addition, water lances require greater precision and control than conventional steam lances afford, for example requiring independent control of the water streams and the ability to turn the water off at a particular water jet when that jet is positioned too close to a heat exchanger tube or directed at a structure that has already been successfully cleaned. Incorporating these capabilities into a water lance that also delivers steam as a cleaning fluid has not been successfully accomplished.

These difficulties are accentuated in the harsh environment of the interior of an operating industrial boiler. Sootblower lances can be quite long, such as 50 feet, depending on the particular boiler. Metal structures, such as tubes, hoses, couplers and nozzles experience extreme heat expansion and expansion-related stresses in this type of environment. Further, the need for long periods of active duty with very low failure rates is almost as critical for the boiler cleaning equipment as for the interior components of the boiler itself, which reduces the availability of complicated systems with intricate moving parts for interior boiler operations.

Accordingly, a continuing need exists for improved sootblowers and related automatic boiler cleaning systems for power plants. More specifically, a need exists for more effective cleaning systems for the platens in industrial boilers.

SUMMARY OF THE INVENTION

The present invention meets the needs described above in a multi-media rotating sootblower that includes multiple rotating and individually controlled cleaning fluid applicators, such a set of steam nozzles and two sets of water nozzles, and an automatic boiler cleaning system using these sootblowers. The boiler superheater typically includes a system of these sootblowers to clean a number of large platens that are arranged in rows. The boiler may also include additional boiler cleaning equipment, including water cannons to clean the furnace, and conventional steam sootblowers to clean other heat exchangers of the boiler. A number of sensors, including heat transfer gauges that measure the heat transfer at the furnace wall, strain gauges that measure the weight of slag deposits on platens, and boiler cameras are used to monitor slag accumulations within the boiler. A control system uses this sensor data to automatically operate the boiler cleaning system to implement an automatic boiler cleaning regimen, which maintains desired boiler thermal output and boiler life by cleaning the interior boiler components while avoiding unnecessary thermal stress that can be caused by cleaning with water.

The multi-media rotating sootblower includes a lance that is linearly inserted into and retracted from the boiler interior while rotating, which deploys cleaning fluids in a corkscrew pattern. The lance typically includes a first set of water nozzles that point forward in the direction of lance insertion to clean one side of a platen as the lances moves past the platen during the insertion pass, and a second set of water nozzles that point rearward in the direction of lance retraction to clean the other side of the platen as the lances moves past the platen during the retraction pass. The forward pointing and rearward pointing nozzles are independently controlled so that each set can be independently turned off, while the other set remains in operation. This allows the sootblower to clean with one set of nozzles while the other set is turned off to avoid damage as those nozzles pass close by other pendent structures, which permits the lance move through the superheater, effectively cleaning and passing close by platens without damaging them.

The control system closely controls the application of water as a cleaning fluid to avoid imposing unnecessary thermal stress on the interior boiler structures. For example, the rotation speed of the lance may be controlled to produce a water stream with a constant progression rate on the boiler structure being cleaned, which varies in distance from the water nozzles as the lance travels through the superheater. This requires the lance to rotate more quickly when cleaning closer boiler structures, and more slowly when cleaning structures that are further away. In addition, boiler cameras may be used to detect successful slag removal to ensure that water is applied to accumulated slag but not to bare platen tubes. Platen strain gauges and heat transfer gauges in the furnace section of the boiler also participate in the slag monitoring and automatic boiler cleaning regimen.

Using a single sootblower to apply different types of cleaning fluids minimizes the number of sootblowers required to implement a multi-media cleaning regimen. The multi-media capability of the lance also enables selective cleaning regimens designed to minimize the thermal shock to the boiler heat exchangers during the cleaning process. In particular, water can be used as a selective cleaning fluid for slag encrusted areas, while steam can be use continuously in a cleaning operation. In addition, one fluid may be used to cool the lance during a dual-media cleaning operation. Specifically, steam application has the effect of cooling the lance while water is also applied by the lance. This prevents overheating of the lance, which allows a dual-media cleaning operation to be sustained longer than a water-only cleaning operation could be sustained under similar boiler conditions. For similar reasons, and to keep the water nozzles from clogging with ash, the sootblower includes a pneumatic system for purging water from the lance and pumping air through the lance water system while steam is uses as a cleaning fluid. This prevents stagnant water in the lance from flashing to steam while the lance is in operation inside the boiler, which could rupture the water lines and destroy the lance.

Generally described, the invention may be implemented as a sootblower for cleaning internal components of a boiler while the boiler is in operation. The sootblower includes a lance tube having at least two separately controlled cleaning fluid applicators. The lance tube rotates as it delivers the separately controlled cleaning fluids to clean the interior components of the boiler. The sootblower also includes a drive system for linearly inserting the lance tube into and retracting the lance tube from the boiler while rotating the lance tube, and a control system for controlling the delivery of the cleaning fluids.

More specifically, the sootblower typically applies steam as first cleaning fluid, and includes a steam tube, on which the lance tube is telescopically received, that delivers steam into an interior cavity of the lance tube. The end of the lance tube typically includes one or more steam nozzles in fluid communication with the interior cavity of the lance tube for directing the steam out of the lance tube and into the boiler interior, and a steam valve controls the delivery of steam to the steam tube. The sootblower also includes a carriage that is propelled by the drive system for telescopically inserting the lance tube into and retracting the lance tube from the boiler while the lance tube rotates and the steam tube remains stationary.

In addition, the sootblower typically applies water as the second cleaning fluid, either by itself or in combination with the first cleaning fluid, and includes a system of water conduits located within the interior cavity of the lance tube for this purpose. A system of water nozzles in fluid communication with the water conduits directs water streams out of the lance tube and into the boiler interior. For example, the sootblower may include a first separately controlled water valve, water conduit and water nozzle system that is pointed toward the direction of lance insertion, and a second separately controlled water valve, water conduit and water nozzle system that is pointed toward the direction of lance retraction. The sootblower also typically includes a water distributor carried by the carriage for delivering water from water supply devices, such as water hoses, to the water conduits while the water conduits rotate with respect to the water supply devices. The sootblower should also include a flexible link between each water conduit and an associated water nozzle to adjust for different thermal expansion properties exhibited by the lance tube and the water conduits.

The sootblower may also include a rotation motor carried by the carriage for rotating the lance tube, and a linear travel motor carried by the carriage for inserting the lance into and retracting the lance from the boiler interior. The sootblower may also include a frame supporting the steam tube and a toothed rack and a rail. The sootblower also typically includes a roller coupled to the carriage and riding on the rail for supporting the linear travel of the carriage, and a pinion gear driven by the linear travel motor and engaged with the rack for driving the linear travel of the lance tube. The sootblower may also include a hose take-up tray supported by the frame and providing a folding linkage that supports the water hoses, which feed the water distributor as the carriage moves along the steam tube.

The control system for the sootblower generally includes a system of strain gauges measuring the accumulation of ash deposits on interior boiler components and automatically triggering operation of the sootblower to clean the components with steam, water or a combination of steam and water upon detection of predetermined levels of accumulation. The control system may also be configured to control the rotation and linear motion of the lance tube to apply a substantially constant progression of the water and steam streams as they contact an internal boiler component. Further, the control system may include a system of boiler cameras viewing the interior boiler components and may automatically discontinue operation of the sootblower to clean components, or portions of components, upon detection of successful cleaning. This avoids the application of water to bare heat exchangers, which could damage the tubes of the heat exchangers.

The invention may also be deployed as a power plant having a boiler with a thermal output rating, and as an automatic cleaning system for the boiler configured to automatically clean the boiler to maintain the thermal output rating. The automatic cleaning system includes boiler monitoring equipment for detecting an ash accumulation condition of the interior of the boiler, and boiler cleaning equipment for cleaning the interior of the boiler while the boiler is in operation including at least one multi-media rotating sootblower. The automatic cleaning system also includes a control system configured to receive sensor data from the boiler monitoring equipment, determine the ash accumulation condition of the interior of the boiler based on the sensor data, and to generate control signals to automatically activate and control the boiler cleaning equipment in response to the ash accumulation condition.

In view of the foregoing, it will be appreciated that the present invention avoids the drawbacks of prior sootblowers for cleaning industrial boilers and provides an improved automatic boiler cleaning system. The specific techniques and structures for creating multi-media rotating sootblowers and associated automatic boiler cleaning systems, and thereby accomplishing the advantages described above, will become apparent from the following detailed description of the embodiments and the appended drawings and claims.

DETAILED DESCRIPTION OF EXEMPLARY EMBODIMENTS

Figure 1:
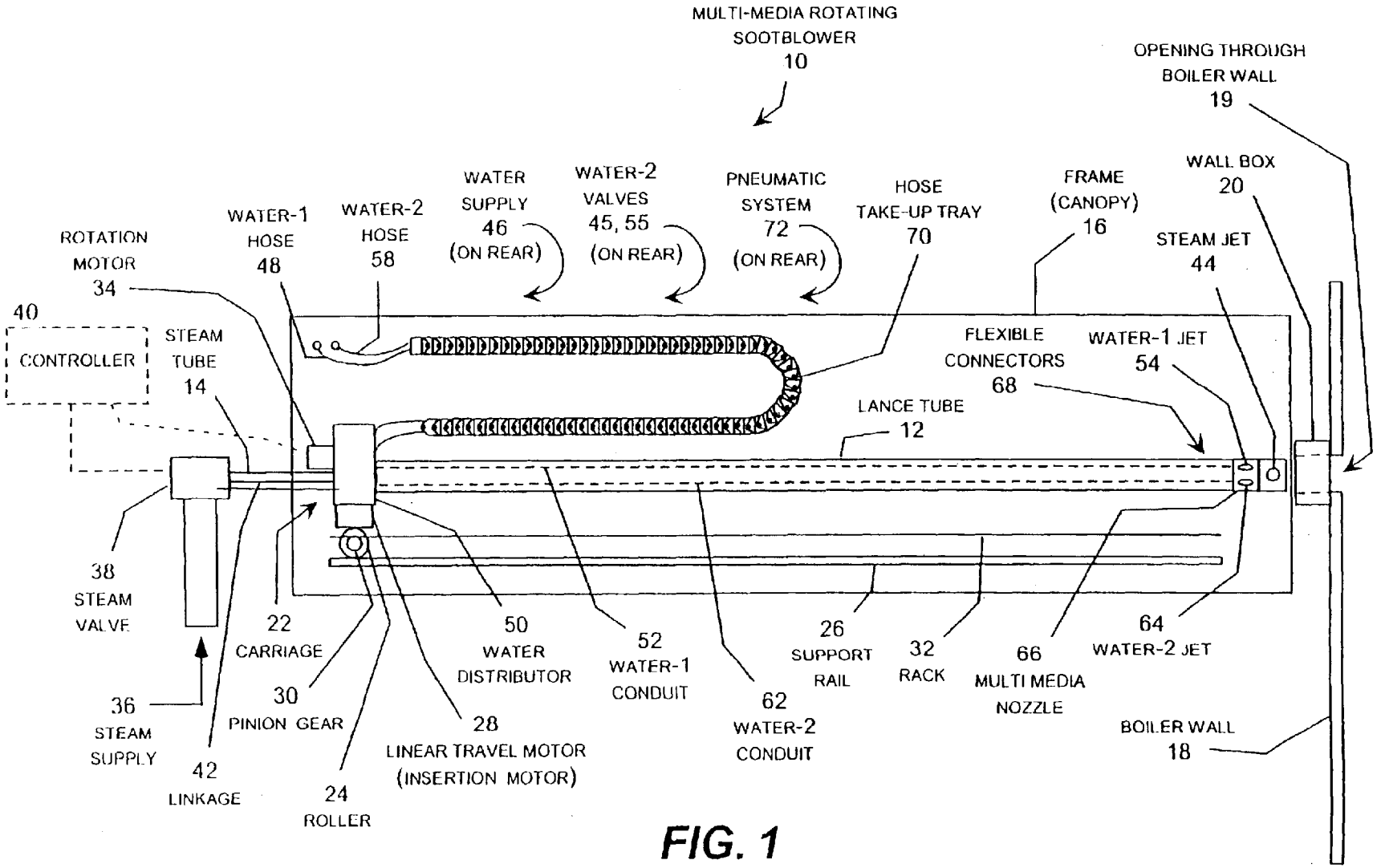
FIG. 1 is a conceptual illustration of a multi-media rotating sootblower.

The present invention relates to a multi-media rotating sootblower and associated automatic boiler cleaning systems. In general, the sootblower selectively applies two cleaning fluids, typically water and steam, which may be applied individually or in combination during a cleaning operation. However, the principles realized by the exemplary embodiments of the invention as described in this specification may be directly modified and extrapolated to develop sootblowers capable of applying more than two independently controlled cleaning fluids, having more than two independently controlled systems for applying any particular cleaning fluid, and for applying different types of cleaning fluids, such as air, solvents, sand blast streams, bead blast streams, liquid nitrogen or other very cold fluids, superheated plasma or other very hot fluids, or any other cleaning fluid that may be appropriate for a particular application. It should also be appreciated that the sootblower may be used for purposes other than cleaning, such as applying paint, sealant, or other desired coatings to interior boiler components.

The exemplary sootblower described below also includes two independently controlled water application systems, which each include two nozzles. Of course, the number of independently controlled water systems, and the number of nozzles included in each water application system, are design choices that may be altered to meet the objectives of a particular application. Similarly, the exemplary sootblower includes a single steam application system with two nozzles, but additional steam systems and different numbers of steam nozzles may be included, as desired, for particular applications.

The particular multi-media rotating sootblower and associated automatic boiler cleaning system described below are well adapted for use in large-scale coal-fired, oil-fired and trash-fired boilers that are typically used to generate electric power and heat or process steam for industrial enterprises, such as electricity generation, paper manufacturing and municipal incineration. Nevertheless, it should be understood that these or modified sootblowers may also be used in other types of industrial boilers, such as wood, straw, peat and manure-fired boilers, as well as heat recovery boilers commonly used in steel and aluminum smelters, chemical manufacturing, oil refineries, and other industrial processes. Basically, all industrial boilers can benefit from effective cleaning, and a variation of the multi-media rotating sootblower described below may be readily adapted to any particular industrial boiler configuration and cleaning requirement.

It should also be understood that many design modifications and additions may be readily deployed with the particular commercial embodiment described below, such as independently articulating and controlled nozzles, articulating lances (which are described below as rotating and linearly traveling, but not otherwise articulating), pulsating cleaning fluid streams, varying pressure cleaning fluid streams, alternating cleaning media fluid streams, and so forth. However, each of these modifications would add cost and complexity to the system. Therefore, it should also be appreciated that the preferred sootblower described below is presently considered by the inventors to embody the most technically and economically feasible sootblowers for today's industrial boilers, and in particular the boilers found in oil-fired, coal-fired and trash-fired boilers in power plants used for electricity generation and waste incineration, as well as boilers used in paper manufacturing, oil refining, steel and aluminum smelting.

Turning now to the figures, in which similar reference numerals indicate similar elements in the several figures, FIG. 1 is a conceptual illustration of a multi-media rotating sootblower 10, which shows the major components of an illustrative embodiment of the present invention. This particular embodiment of the invention includes a single rotating and linearly traveling lance tube 12 that carries a separately controlled steam application system along with two separately controlled water application systems. More specifically, the lance tube 12 is telescopically mounted on a steam tube 14, which is mounted to a fixed frame 16. The frame may also include a two or three-sided hood positioned above the lance and steam tube assembly, in which case it may be referred to as a "canopy." The frame, in turn, is ordinarily welded or bolted in place adjacent to the outer wall 18 of an industrial boiler, with the nozzle end of the lance tube 12 positioned for insertion into the boiler at a desired cleaning location. The lance tube 12 is typically inserted through an opening 19 in the boiler wall 18 that is regulated by a wall box 20, which maintains a seal between the boiler wall and the lance tube while the lance rotates and moves into and out of the boiler. In some boiler configurations, particularly those operating with positive boiler pressure (i.e., internal boiler pressure above one atmosphere) the lance may be configured to extend into the wall box in the fully retracted position to plug the opening in the boiler wall, which may also include a auxiliary cover. In other configurations, particularly those operating with negative boiler pressure, the lance may be removed from the wall box as shown in FIG. 1 when the lance is in the fully retracted position.

The rear end of the lance tube 12 is mounted to a carriage 22, which is supported by a pair of rollers (only one roller 24 is shown in FIG. 1) that each ride along the top side of a support rail (only one support rail 26 is shown in FIG. 1) mounted to the frame 16. The carriage also supports a linear travel motor 28, which is also called an insertion motor, that drives a pair of pinion gears (only one pinion gears 30 is shown in FIG. 1). The pinion gears 30, in turn, each engage a toothed rack (only one toothed rack 32 is shown in FIG. 1), which are also supported by the frame 16. The carriage also supports a rotation motor 34 that rotates the lance tube 12 about the steam tube 14 as the linear travel motor 28 drives the pinion gears 30 to telescopically move the lance tube 12 along the steam tube 14. That is, the lance tube 12 rotates about and travels telescopically along the steam tube 14, which is supported by the frame 16 and remains stationary. It should be appreciated that the rotation and linear travel motors, as well as the rollers, rails, rack and pinion gear assembly may be located in positions other than as shown in FIG. 1. In particular, the carriage 22 may be configured to hang from an overhead canopy-style frame 16, in which case the rollers, rails, rack and pinion gear assembly may be located to the side or above the carriage. See in particular the commercial embodiment illustrated with reference to FIGS. 10–28.

The independently controlled steam application system includes a steam supply 36 provided to a steam valve 38 that controls the introduction of steam into the end of the steam tube 14 located near the carriage 22. The steam valve 38 is typically operated manually, although the computer controller 40 could alternatively be configured to control the operation of the steam valve for automatic and remotely-controlled operation. A linkage 42 connected to the carriage 22 engages a lever located on the steam valve 38 to manually lock the steam valve in a closed position when the carriage 22 in the fully retracted position. The opposing end of the steam tube 14 is open, which allows steam to fill and pressurize the interior cavity of the lance tube 12 with steam whenever the steam valve 38 is open. The interior cavity of the lance tube 12, in turn, is in fluid communication with a pair of nozzles, which are also called steam jets (only one steam jet 44 is shown in FIG. 1). In this particular embodiment, the steam jets have a fixed pointing angle, typically pointing slightly forward in the direction of lance insertion. This pointing angle is a design choice that may be altered by adjusting or changing the steam jets. This arrangement allows the steam tube 14 to inject steam into the lance tube 12 while the lance tube rotates about and telescopes along the steam tube.

The first independently controlled water application system includes a water valve 45 regulating water delivery from a water supply 46 to a water-1 hose 48, which is connected to a first water inlet (element 150 shown on FIG. 10) on a water distributor 50. The water distributor 50 travels linearly with the carriage 22 and includes an outer housing that remains rotationally stationary while an inner sleeve rotates with the lance 12. The water distributor 50 also defines a first pressurized water channel (including elements 160 and 180 shown on FIG. 21) that directs water from the rotationally fixed first water inlet 150 in the outer casing of the water distributor into a pair of water-1 conduits 52 (only one water-1 conduit is shown in FIG. 1). This allows the water distributor 50 to supply water from the water-1 hose 48 to the water-1 conduits 52 while the conduits rotate with respect to the water-1 hose, which remains connected to the non-rotating outer casing of the water distributor. The water-1 conduits 52 connect the water supply 46 to a pair of nozzles or water-1 jets 54 (only one water-1 jet is shown in FIG. 1) located at the opposite end of the lance tube 12. That is, a second water-1 conduit 52 (not shown) also connects the water supply 46 to a second water-1 jet 54 (not shown), which is typically positioned in the same linear position on the opposite side of the lance tube 12. Both of the water-1 jets 54 are typically pointed forward in the direction of lance insertion. A water-1 valve 45, which is typically located on the back side of the frame 16 but may be located in any suitable location in the pluming system, controls the flow of the first water supply 46 into the water-1 conduits 52 under the control of the controller 40.

The second independently controlled water application system is similar to the first, and includes a second water valve 55 regulating the supply of water from the water supply 46 to a water-2 hose 58, which is connected to a second water inlet (element 152 shown on FIG. 10) on the water distributor 50. The water distributor 50 defines a second pressurized water channel (including elements 170 and 182 shown on FIG. 22) that directs water from the rotationally fixed second water inlet 152 in the outer casing of the water distributor into a pair of water-2 conduits 62 (only one water-2 conduit is shown in FIG. 1). This allows the water distributor 50 to supply water from the water-2 hose 58 to the water-2 conduits 62 while the conduits rotate with respect to the water-2 hose, which remains connected to the non-rotating outer casing of the water distributor. The water-2 conduits 62 connect the water supply 46 to a pair of nozzles or water-2 jets 64 (only one water-2 jet is shown in FIG. 1) located at the opposite end of the lance tube 12. That is, a second water-2 conduit 62 (not shown) also connects the water supply 46 to a second water-2 jet 64 (not shown), which is typically positioned in the same linear position on the opposite side of the lance tube 12. Both of the water-2 jets 64 are typically pointed rearward in the direction of lance retraction. A water-2 valve 55 typically located on back side of the frame 16 controls the flow of the second water supply 46 into the water-2 conduits 62 under the control of the controller 40. A pluming system feeding the water valves and a pneumatic system 72 are also typically located on the back side of the frame 16 (see FIGS. 3A–G and 4A–B) but may be located in any other suitable location.

The water and steam jets are mounted in a multi-media nozzle 66, which typically has the same diameter as the lance tube 12 to facilitate entering the lance tube into the boiler through the opening 19 through the boiler wall 18. The water-1 and water-2 conduits are preferably connected to the multi-media nozzle 66 with flexible connectors 68, such as corrugated steel tubes, to allow for different thermal expansion rates between the lance tube 12 and the water conduits. The sootblower 10 also includes a hose take-up tray 70 that includes a number of box links that form a chain that supports the water hoses 48, 58. The hose take-up tray 70 also carries electric cables for powering and controlling the electric components carried by the carriage 22, including the rotation motor 34 and the linear travel motor 28. The take-up tray 70 is configured to fold back in an adjustable-length loop while remaining sufficiently rigid to support the water hoses 48, 58 and the electric cables while the carriage 22 moves back and forth along the steam tube 14.

Figure 2A:
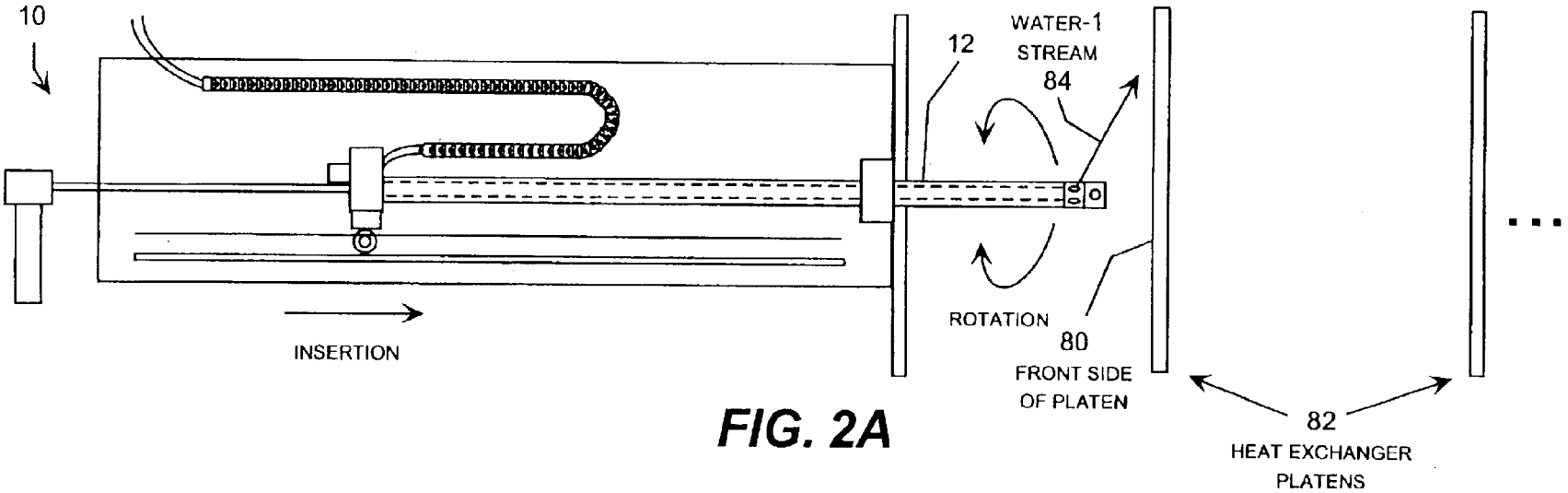
FIG. 2A is a conceptual illustration of the multi-media rotating sootblower of FIG. 1 cleaning a first side of a superheater platen.
Figure 6:
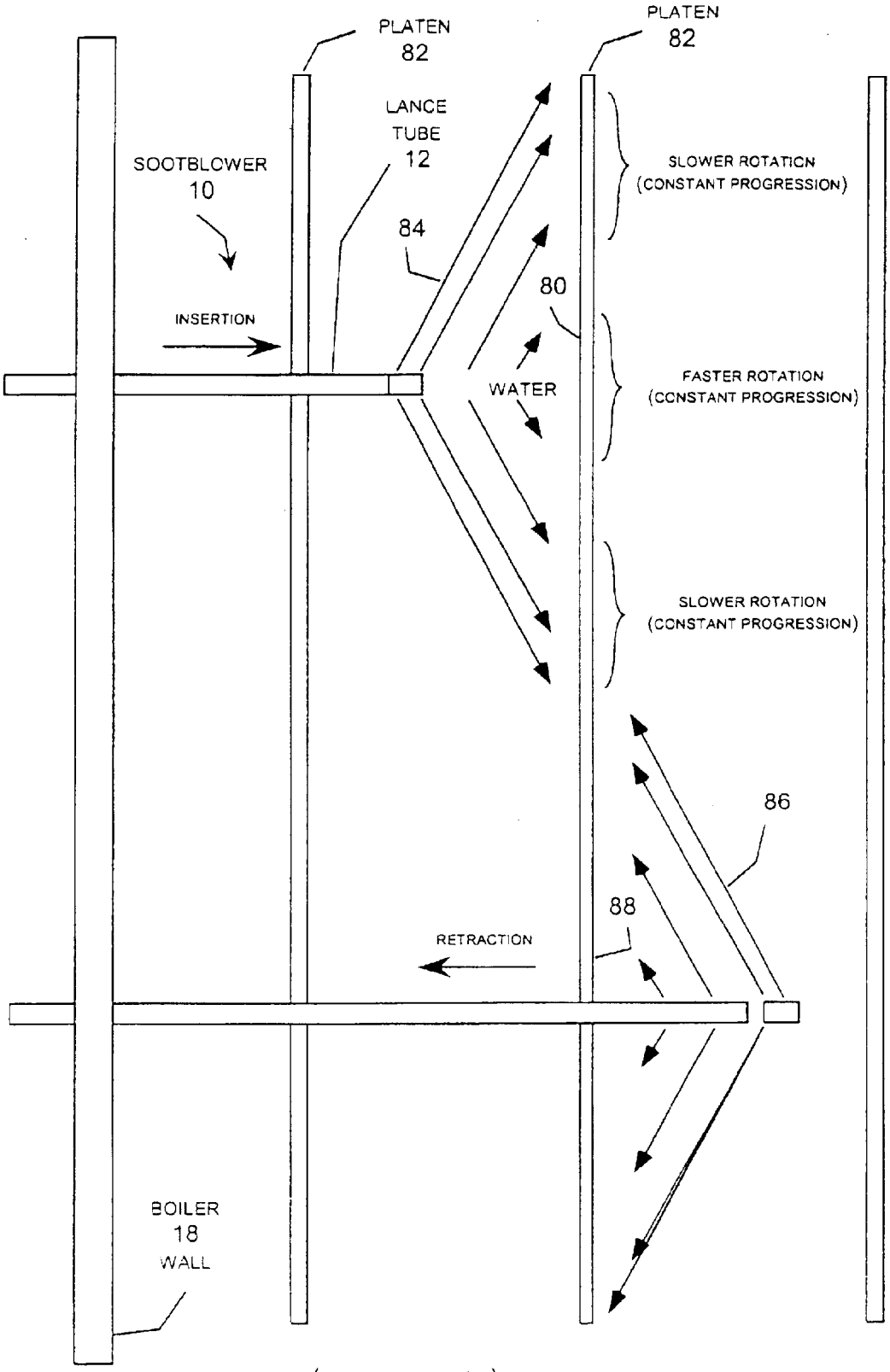
FIG. 6 is a conceptual boiler side view showing a multi-media rotating sootblower illustrating the cleaning principle of constant water stream progression.
Figure 7A:
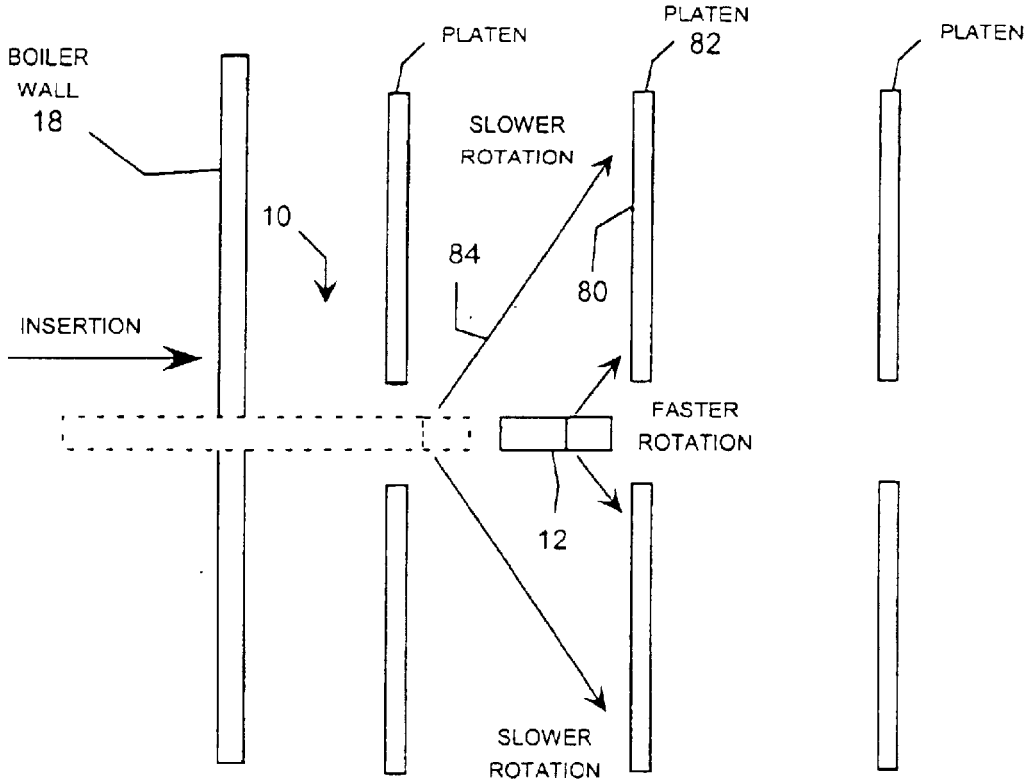
FIG. 7A is a conceptual boiler top view showing a multi-media rotating sootblower illustrating the cleaning principle of constant water stream progression to a first side of a platen.
Figure 7B:
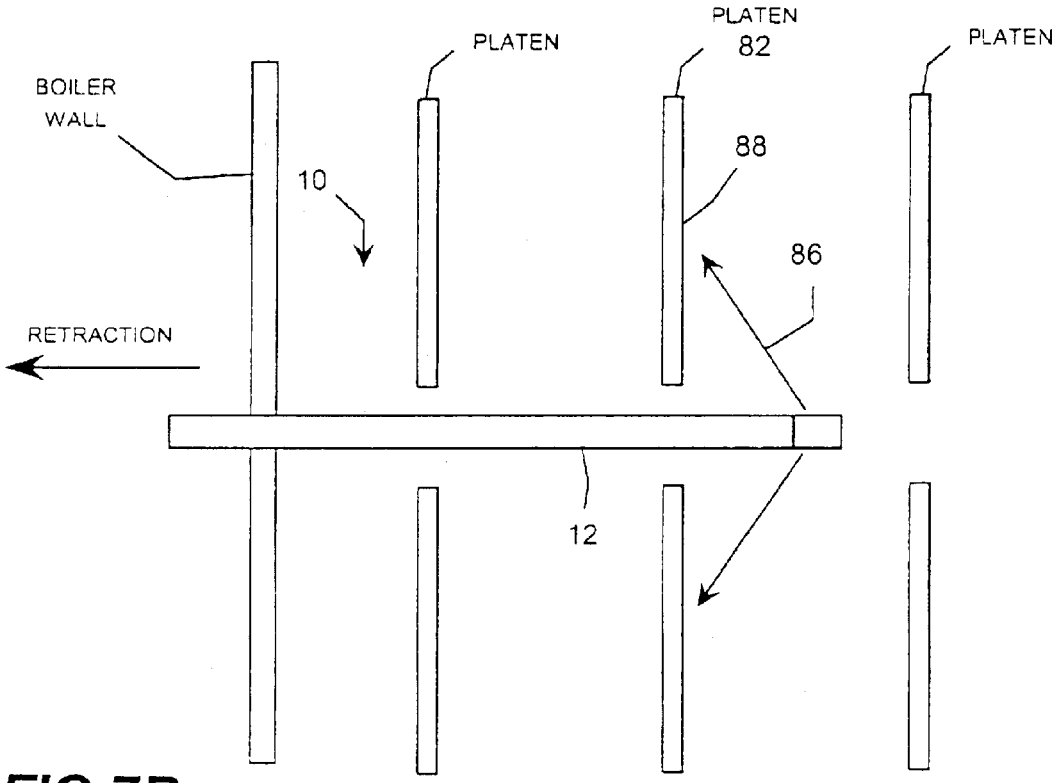
FIG. 7B is a conceptual boiler top view showing a multi-media rotating sootblower illustrating the cleaning principle of constant water stream progression applied to the other side of the platen illustrated in FIG. 7A.

FIG. 2A is a conceptual illustration of the multi-media rotating sootblower 10 cleaning a first side 80 of a superheater platen 82. The configuration of the platens with respect to the lance during a typical cleaning operation is also shown in FIGS. 6 and 7A–B. The lance sprays a water-1 stream 84 from the water-1 jet 54, which is pointed forward in the direction of lance insertion. As noted previously, the lance 12 rotates as it travels linearly, which causes the water-1 stream 84 to advance in a corkscrew pattern.

Figure 2B:
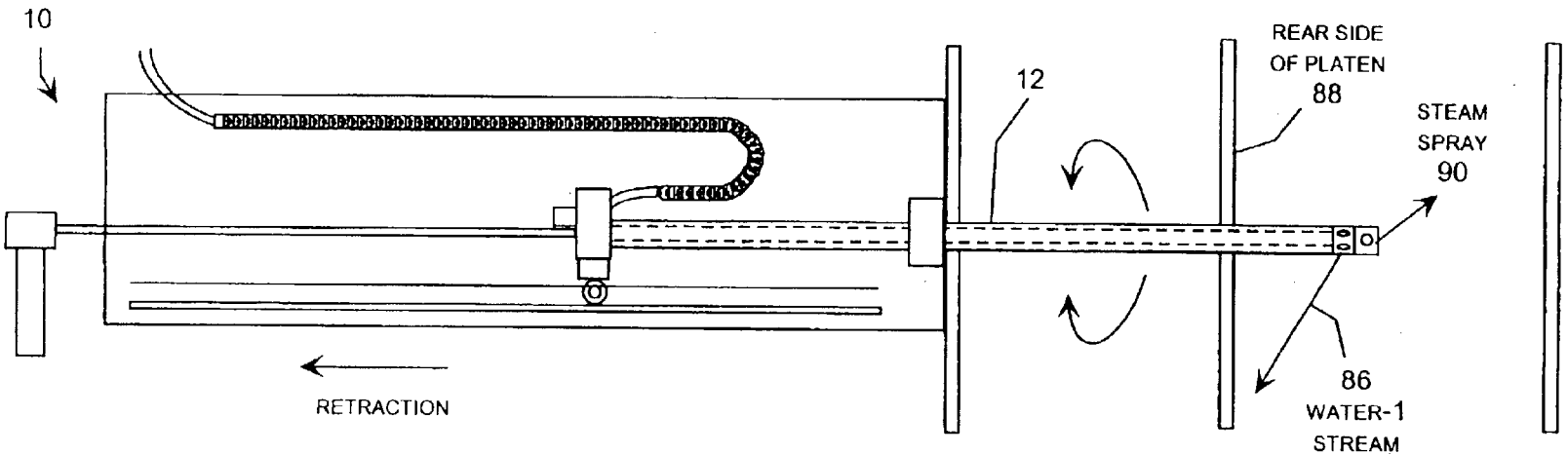
FIG. 2B is a conceptual illustration of the multi-media rotating sootblower of FIG. 2A cleaning an opposing side of the superheater platen.

Therefore, the portion of the platen side 80 cleaned by the water-1 stream 84 gets closer to the lance 12 as the lance approaches the platen 82. The water-1 stream 84 typically cleans a pair of rows of parallel platens during an insertion pass, with one row of platens located on opposing sides of the lance insertion path (see FIGS. 7A–B). The water-2 stream 86 subsequently cleans the back sides of the same platens during a retraction pass. This is illustrated in FIG. 2B, in which the water-2 stream 86 is shown cleaning the back side 88 of the platen 82. Of course, a steam spray 90 may alternatively or additionally be used to clean either or both sides of the platen 82. For example, the steam spray 90 may be used to clean the platen 82 several times a day or hourly, whereas water cleaning may be applied selectively to slag-encrusted areas platen on an as-needed basis or according to a less frequent regularly-scheduled cleaning regimen.

FIGS. 3A–G and 10–28 include three-dimensional computer-assisted design (CAD) illustrations of a specific commercial embodiment of the multi-media rotating sootblower 10 shown to scale (excluding the fan 302, which is shown conceptually). This commercial embodiment represents the best mode currently known by the inventors for practicing this aspect of the invention, and the dimensions shown are typical for an industrial sootblower. However, the particular dimensions are design choices that will change based on the particular portion of the particular boiler that the sootblower is designed to clean.

Figure 3A:
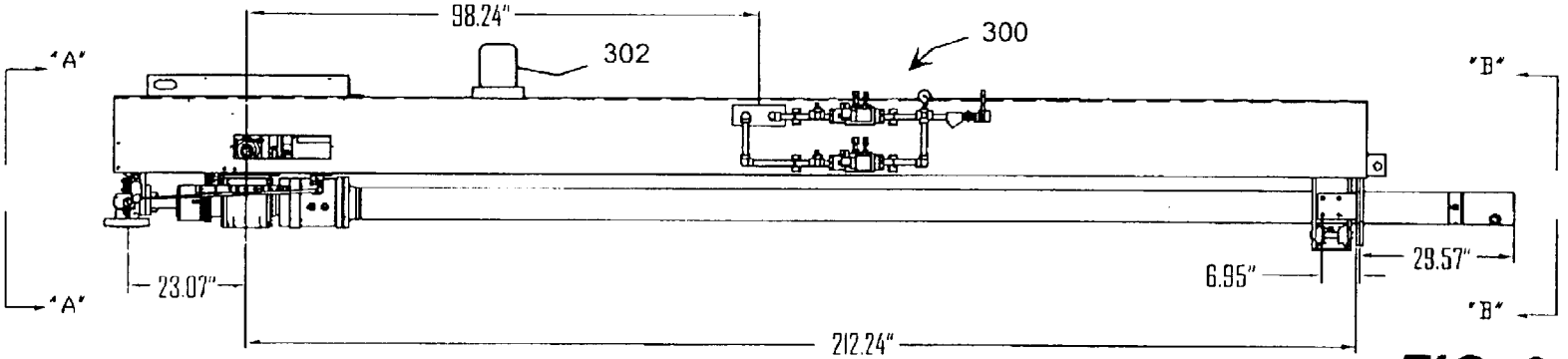
FIG. 3A a rear side view of a multi-media rotating sootblower shown to scale and showing a pluming configuration of the sootblower.

FIG. 3A a side view of the sootblower 10 showing a pluming configuration 300, which feeds the water hoses 48, 58 described with reference to FIG. 1. The sootblower 10 also includes a pneumatic fan 302 that provides low pressure air for sealing the wall box 20 and forcing a constant flow of air through the sootblower water system to prevent boiler gasses from enter the water nozzles during steam blowing. It is desirable to run air through the water system of the sootblower whenever the lance is in operation without applying water. The constant flow of low pressure air from the fan 302 cools the lance and prevents the water nozzles from clogging with ash. Therefore, air from the fan 302 is normally run through the lance when steam, but not water, is being used as a cleaning fluid. In addition, high pressure air, typically from an on-site plant pneumatic system or air compressor, is used to flush the water form the water system. It is important to flush the water from the lance after water is used as a cleaning fluid to prevent the water from dripping out of the lance when parked. It is also desirable to flush the water system to prevent stagnant water in the lance tube from overheating while the lance is inside the boiler, which could cause the water to flash to steam and rupture the conduits inside the lance tube.

Figure 3B:
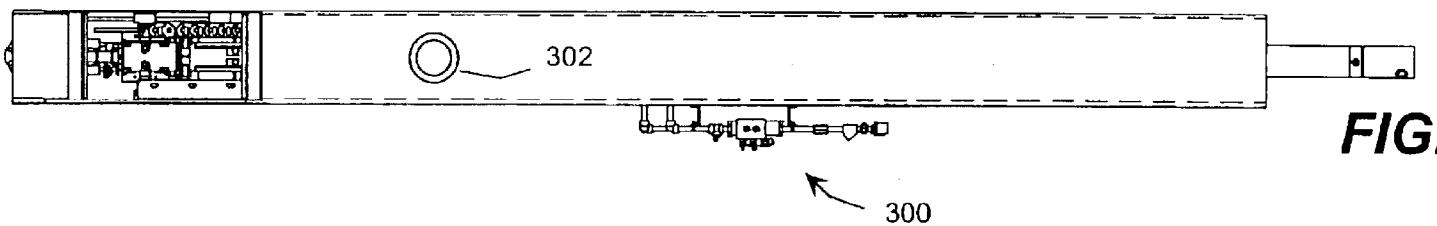
FIG. 3B is a top view of the sootblower showing the pluming configuration.
Figure 3D:
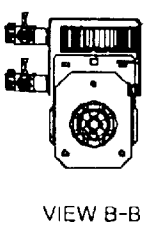
FIG. 3D is an opposite end view of the sootblower.
Figure 3C:
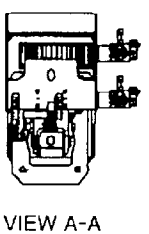
FIG. 3C is an end view of the sootblower showing the pluming configuration.
Figure 3E:
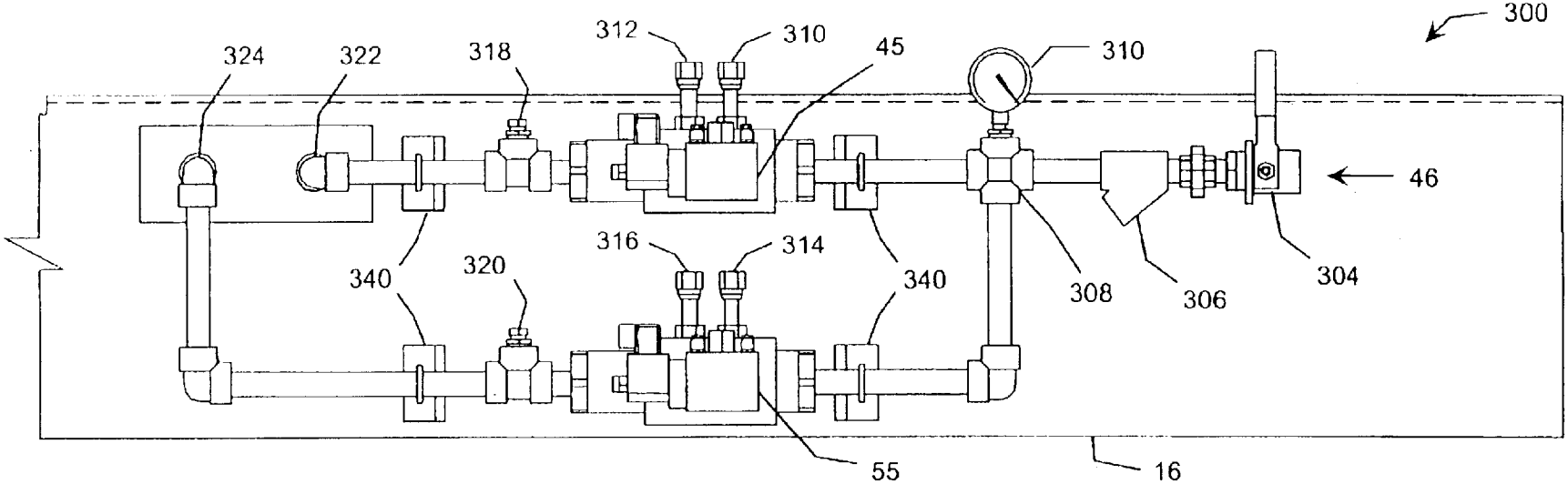
FIG. 3E is a side view of the pluming configuration.

In FIGS. 3A–E, the tubes of the pneumatic system are not shown to reduce clutter. However, the pneumatic pluming itself is conventional and represented on the Process Instrumentation Drawing of FIGS. 4A–B. FIG. 3B is a top view of the sootblower 10 showing the pluming configuration 300, and FIGS. 3C and 3D are end views of the sootblower showing the pluming configuration. FIG. 3E is a closer side view of the pluming configuration 300. The water supply 46 is connected to a main manual water shut-off valve 304. The pluming then proceeds through a strainer 306 to a "T" splitter 308, which is fitted with a water pressure gauge 310. From the splitter, one pipe goes to the water-1 valve 45 and another pipe goes to the water-2 valve 55. The water-1 valve 45 includes a locally-controlled pneumatic valve 310 and a remotely-controlled pneumatic valve 312 equipped with a computer-controlled actuator operated by the control system 40 (shown on FIGS. 1 and 9). From the water-1 valve 45, the pluming continues through a pneumatic inlet 318, which is connected to the pneumatic system 72 for purging the water from and running air through the sootblower water system, to a 90 degree turn 322, which passes through the frame 16 to a connection for the water-1 hose 48.

Figure 3G:
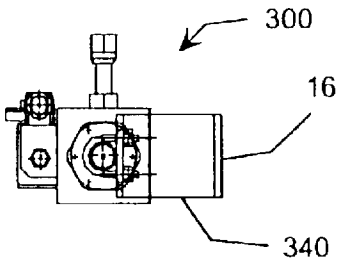
FIG. 3G is an end view of the pluming configuration.
Figure 3F:
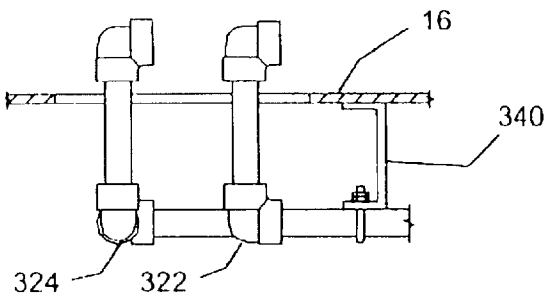
FIG. 3F is a top view of a portion of the pluming configuration.

The second pluming line is similar, and includes a locally-controlled pneumatic valve 314 and a remotely-controlled pneumatic valve 316 for the water-2 valve 55 equipped with a computer-controlled actuator operated by the control system 40. From the water-2 valve 55, the pluming continues through a pneumatic inlet 320 connected to the pneumatic system 72 to a 90 degree turn 324, which passes through the frame 16 to a connection for the water-2 hose 58. The pluming system 300 is mounted to the frame 16 by four channel brackets 340. FIG. 3F is a top view of the 90 degree turns 322, 324 passing through the frame 16, and FIG. 3G is an end view of the pluming configuration 300.

Figure 4A:
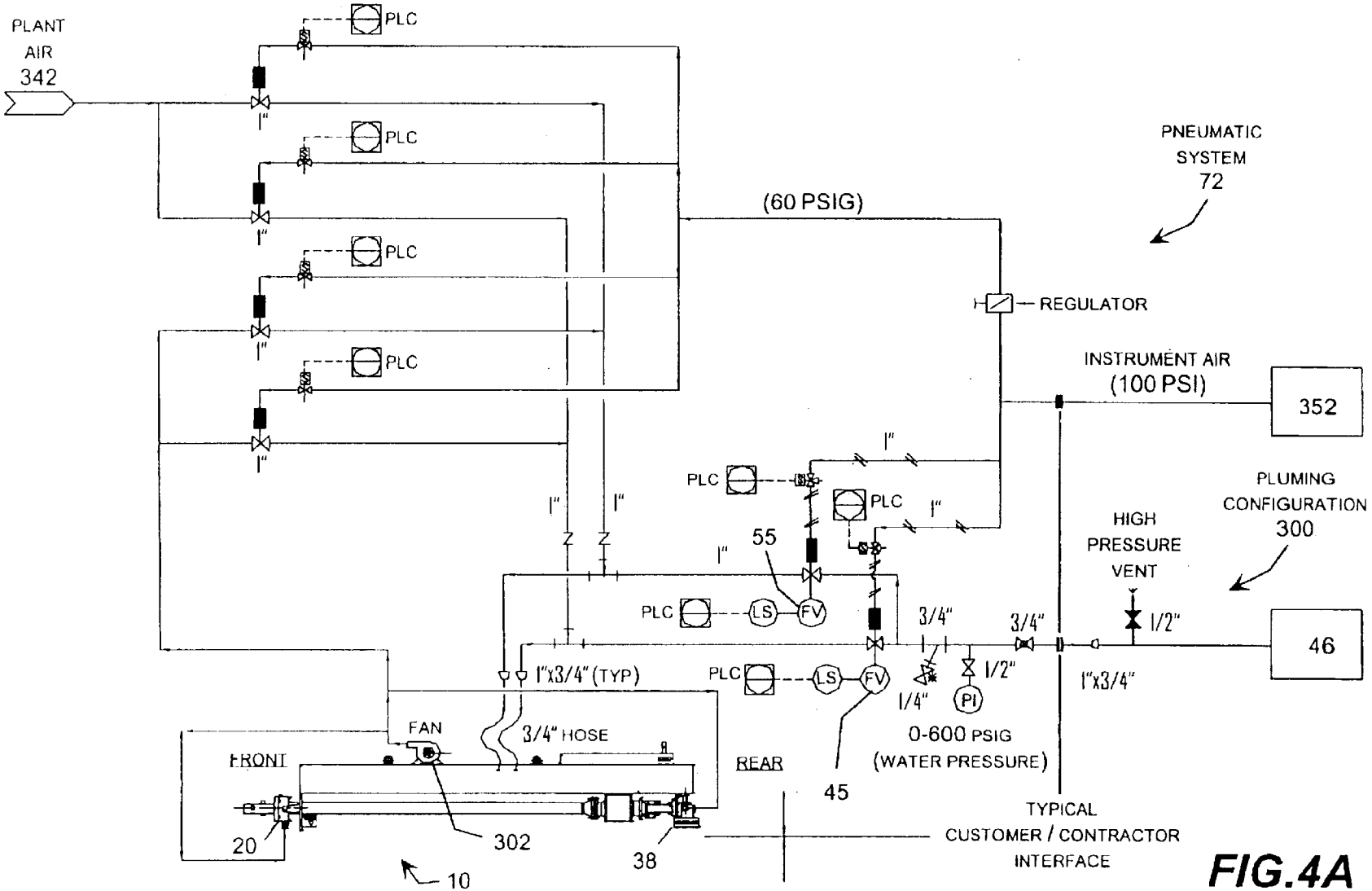
FIG. 4A is a Process Instrument Diagram for the sootblower of FIG. 3.
Figure 4B:
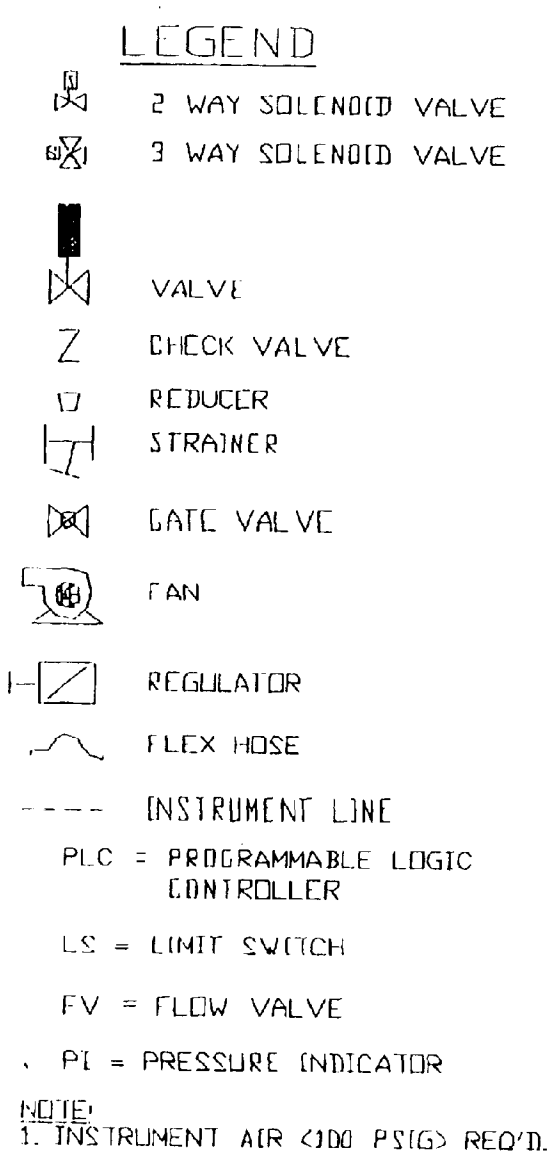
FIG. 4B is a legend for the Process Instrument Diagram of FIG. 4.

FIG. 4A is a Process Instrument Diagram (PID) for the sootblower 10, which illustrates the pluming system 300 and the associated pneumatic system 350 along with electrical connections to the controller 40 (labeled PLC in FIG. 4A). The fan 302 provides low pressure air to seal the wall box 20 and feed air through the water system of the sootblower 10. As noted previously, this air is used to prevent boiler gasses from entering the water nozzles and to prevent the water nozzles from clogging with ash. The pneumatic system 350 also includes a plant air source 342, which provides high-pressure air for purging the water from the lance after a water blowing cycle. The plant air source 342 also provides instrument air 352 for operating the pneumatically-controlled water valves 45, 55. The remaining elements of the pluming system 300 and the associated pneumatic system 350 are conventional and denoted by their usual symbols in FIG. 4A. FIG. 4B is a legend for the PID of FIG. 4.

Figure 5A:
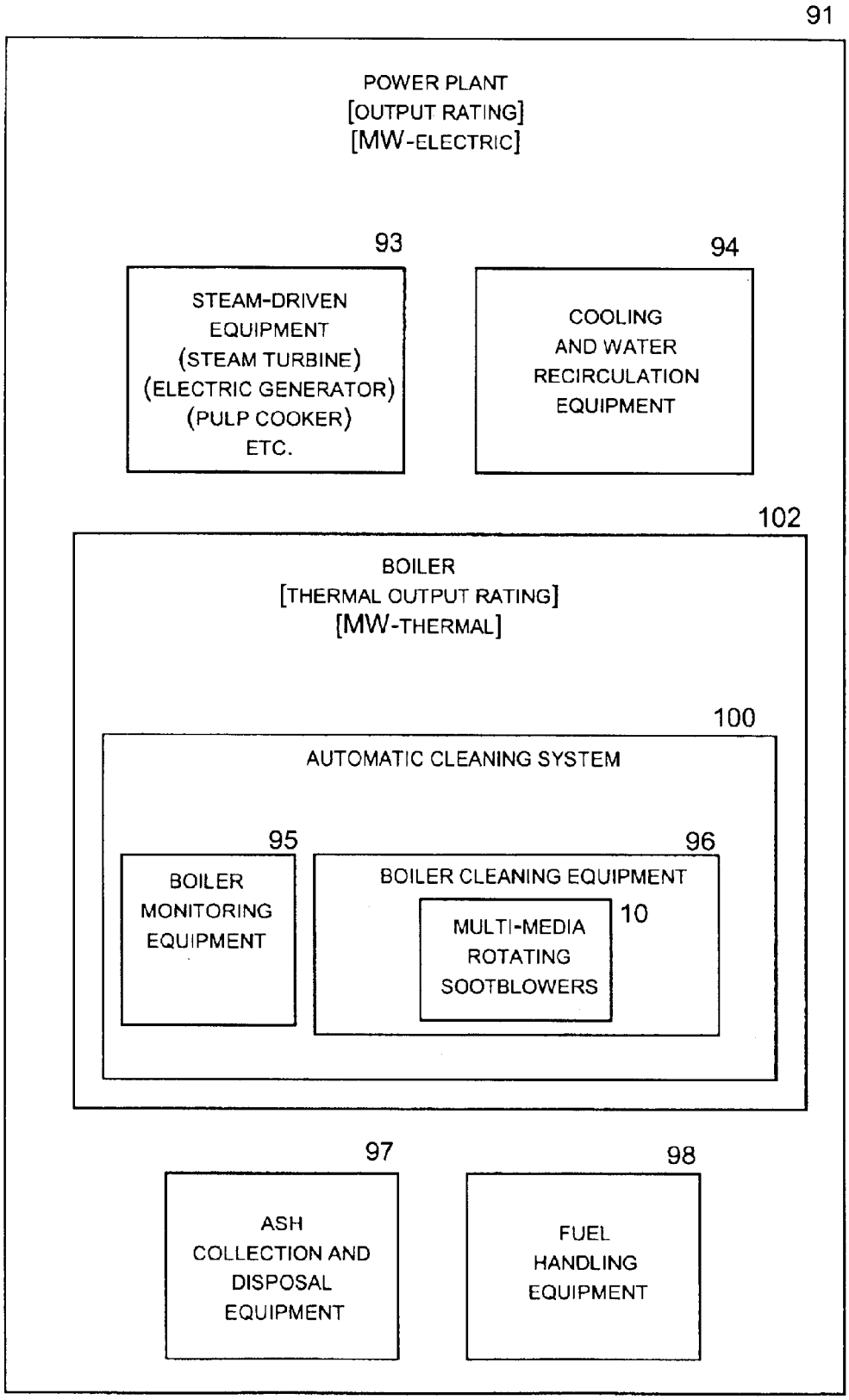
FIG. 5A is a block diagram of a power plant including an industrial boiler with an automatic cleaning system using multi-media rotating sootblowers.

FIG. 5A is a block diagram of a power plant 91 including an industrial boiler 102 with an automatic cleaning system 100 that includes a system of strategically placed multi-media rotating sootblowers 10. The power plant 91, which is intended to represent any of a wide range of industrial power plants, generally includes steam-driven equipment 93, such as a steam turbine and electric generator in the case of an electricity plant, a pulp cooker in the case of a paper manufacturing plant, or other equipment driven by steam created by the boiler 102. The power plant also generally includes water cooing and recirculation equipment 94, ash collection and disposal equipment 97, and fuel handling equipment 98. Except for the automatic boiler cleaning system 100, the industrial boiler 102 is conventional and, therefore, will not be described in detail.

It should be appreciated that the output rating of the power plant 91, such as its MW-electric rating in the case of an electricity plant, relies on the thermal output of the boiler 102, which is typically expressed as a MW-thermal rating. Further, accumulated ash and slag in the boiler 102 reduces the heat transfer capability of the heat exchangers within the boiler, which reduces the thermal output of the boiler, which reduces the efficiency of the power plant 91. If the heat transfer capability is not regularly restored through an effective cleaning regimen, the output rating of the power plant 91 may be reduced, which would be a very expensive consequence for the owner of the plant. For this reason, the output ratings of the boiler and power plant both depend on an effective cleaning regimen for the boiler 102. The boiler life also depends on a cleaning regimen that minimizes the thermal shock imposed on the heat exchanger tubes during the cleaning process. The automatic boiler cleaning system 100, which includes a system of strategically placed multi-media rotating sootblowers 10 along with boiler monitoring equipment and a control system, implements such a cleaning regimen to maintain the thermal output rating of the boiler and the electric output rating of the power plant 91 at the desired levels while minimizing the thermal shock imposed on the heat exchanger tubes within the boiler during the cleaning process.

Figure 5B:
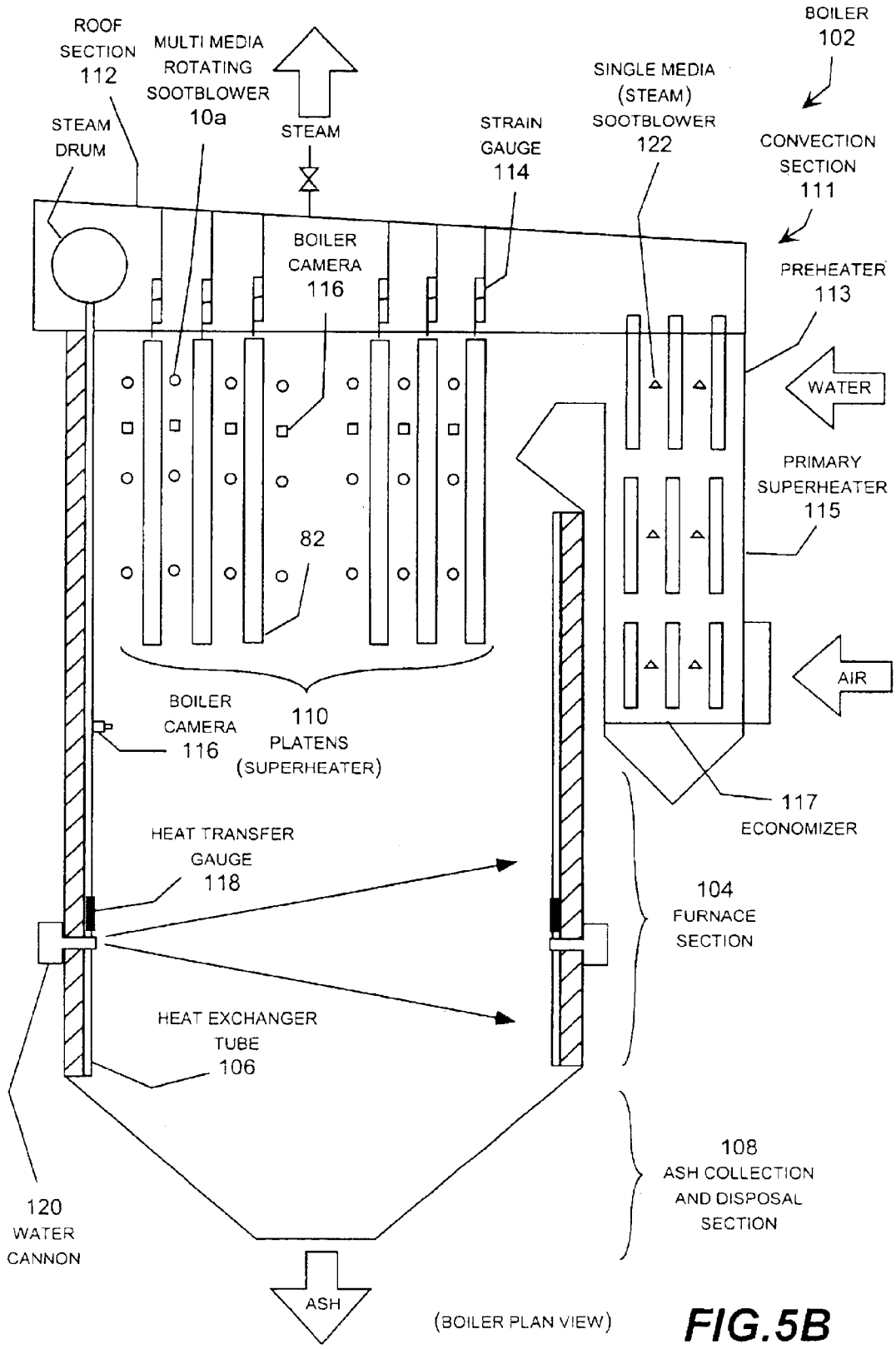
FIG. 5B is a conceptual illustration of the boiler of FIG. 5.
Figure 9:
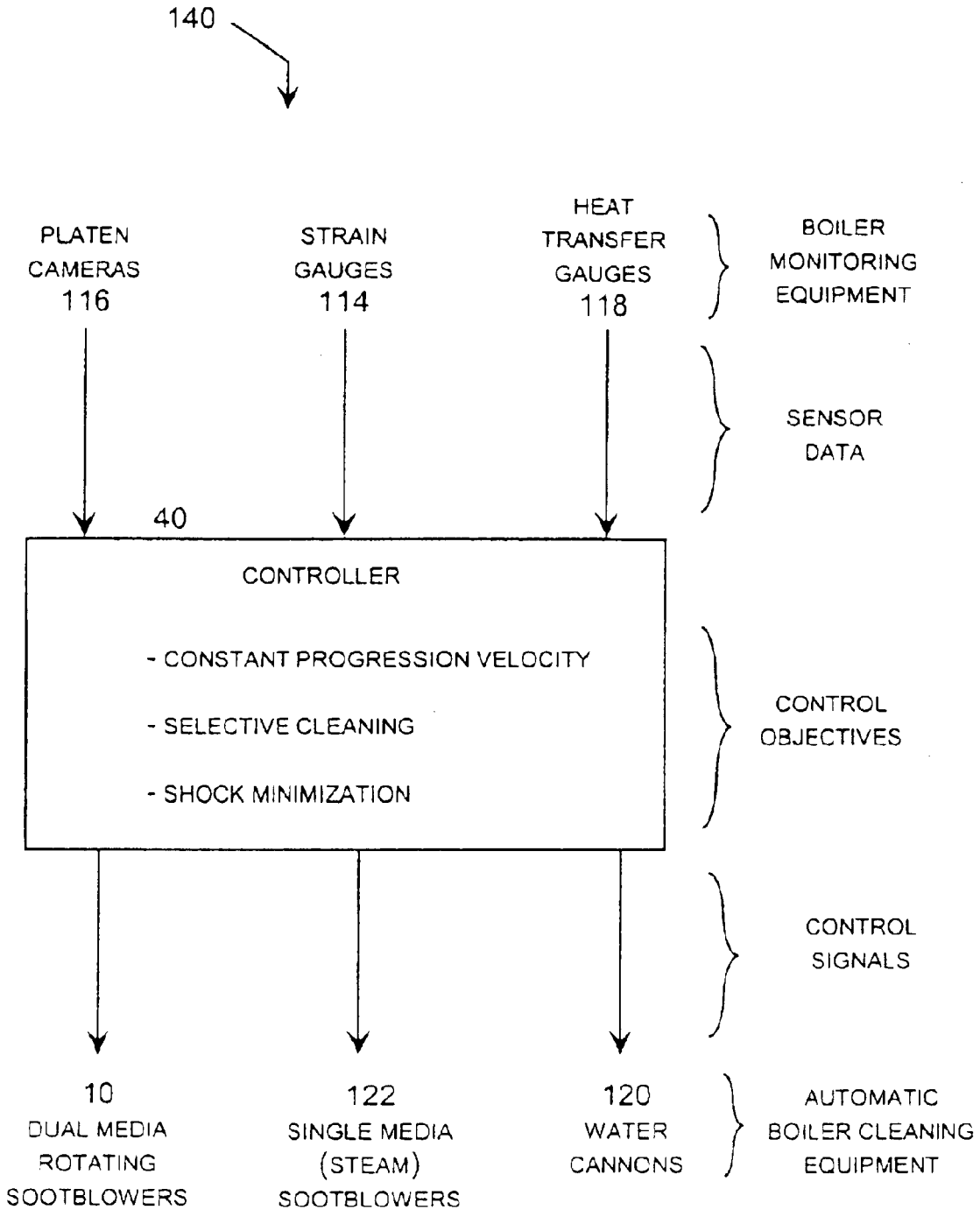
FIG. 9 is block diagram illustrating a control system for an automatic boiler cleaning system.

FIG. 5B is a conceptual illustration of the industrial boiler 102, which includes the automatic boiler cleaning system 100. FIG. 9 also shows a block diagram illustrating a control system 40 for the automatic boiler cleaning system 100. The boiler 102 structure is typically in the range of about 150 to 250 feet [about 45 to 75 meters] tall. Generally described, the boiler includes an open furnace section 104 housed within walls constructed from heat exchanger tubes, represented by the heat exchanger tube 106, which carry pressurized water heated by the furnace. An ash collection and disposal section 108 is located below the furnace, which collects ash as it is created in the furnace section 104 during the combustion process in a hopper and transports it away from the boiler for disposal, typically using a conveyor or rail car. A platen superheater section 110 is located directly above the furnace, which includes a number of platens constructed from heat exchanger tubes that hang from the boiler roof section 112, suspended above the combustion zone within the furnace 104. The boiler 102 also includes a number of lower-temperature heat exchangers identified as the convection zone 111, which in this example includes a pre-heater 113, a primary superheater 115 and an economizer 117.

The boiler monitoring equipment includes a number of strain gauges, as represented by the strain gauge 114, that measure the weight of the platens, which increases as slag accumulates on the platens. Typical strain gauges of this type are described in Jones, U.S. Pat. No. 6,323,442, which is incorporated herein by reference. A number of boiler cameras, as represented by the boiler camera 116 (boiler cameras are denoted by squares) are strategically located with the boiler to view to the platens and other heat exchangers. In addition, the boiler tubes in the furnace section 104 typically include a number of in-line heat transfer gauges, as represented by the illustrative heat transfer gauge 118 shown in-line with the heat exchanger tube 106, which measure the heat transferred from the furnace to the heat exchanger tubes in the furnace wall. The boiler camera 116 and heat transfer gauge 118 are conventional, and will not be described further. It should also be understood that the particular number and locations of boiler cameras and transfer gauges shown in FIG. 5 are merely illustrative, and will vary from application to application.

The boiler cleaning equipment typically includes a number of multi-media rotating sootblowers 10 (multi-media rotating sootblowers are denoted by circles) positioned to clean the platen section 110. The number of multi-media rotating sootblowers 10 deployed in any particular plant will vary from plant to plant, and will be based on cost and other considerations. In addition, typically about 4 to 8 water cannons, as represented by the water cannon 120, are typically positioned to clean the furnace section 104. Further, typically about 10 to 20 single-media sootblowers 122 (e.g., water or steam sootblowers, which are denoted by triangles) are also positioned to clean the lower-temperature heat exchangers 113, 115 and 117. Again, it should be understood that the number and locations of sootblowers and water cannons shown in FIG. 5 are merely illustrative, and will vary for each application.

The control system 40 shown on FIGS. 1 and 9 controls the boiler cleaning equipment 10, 120, 122 in response to sensor data received from the boiler monitoring equipment 114, 116, 118 to attain control objectives designed to implement selective cleaning while minimizing thermal shock to the heat exchangers. In particular, the control system 40 operates the multi-media rotating sootblowers 10 to maintain constant water and stream progression velocity, as described with reference to FIGS. 6 and 7A–B. The control system 40 also uses sensor data from the boiler cameras 116 to implement selective cleaning to minimize water shock, as described with reference to FIG. 8.

FIG. 6 is a conceptual boiler side view showing a multi-media rotating sootblower 10 illustrating the cleaning principle of constant water stream progression. During the cleaning process, the lance tube 12 approaches the platen 82, which typically includes a face 80 to be cleaned positioned perpendicular to and adjacent to the lance tube insertion path. This arrangement is also shown in a boiler top view (plan view) in FIGS. 7A and 7B. Because the angle of the water-1 stream 84 is fixed with respect to the lance 12, the portion of the platen face 80 contacted by the water-1 stream moves closer to the lance as the lance approaches the platen. Therefore, to keep the progression rate of the water-1 stream 84 constant on the platen face 80, the rotational speed of the lance 12 increases as the lance approaches the platen face. The linear insertion rate of the lance 12 may also be varied in this process. Furthermore, the water-1 stream 84 is typically turned off as the water-1 jet 54 passes close by the edge of the platen 80 to avoid damaging the platen. As show in FIG. 7B, a similar cleaning operation is applied to the rear side 88 of the platen 82 during the return pass. Moreover, two rows of parallel platen panels are typically cleaned by a single sootblower, as shown conceptually in FIGS. 5 and 7A–B. This cleaning operation of the lance 12 may be governed automatically by the controller 40, or it may be controlled in real time by an operator monitoring the cleaning process with the system of boiler cameras 116.

Figure 8A:
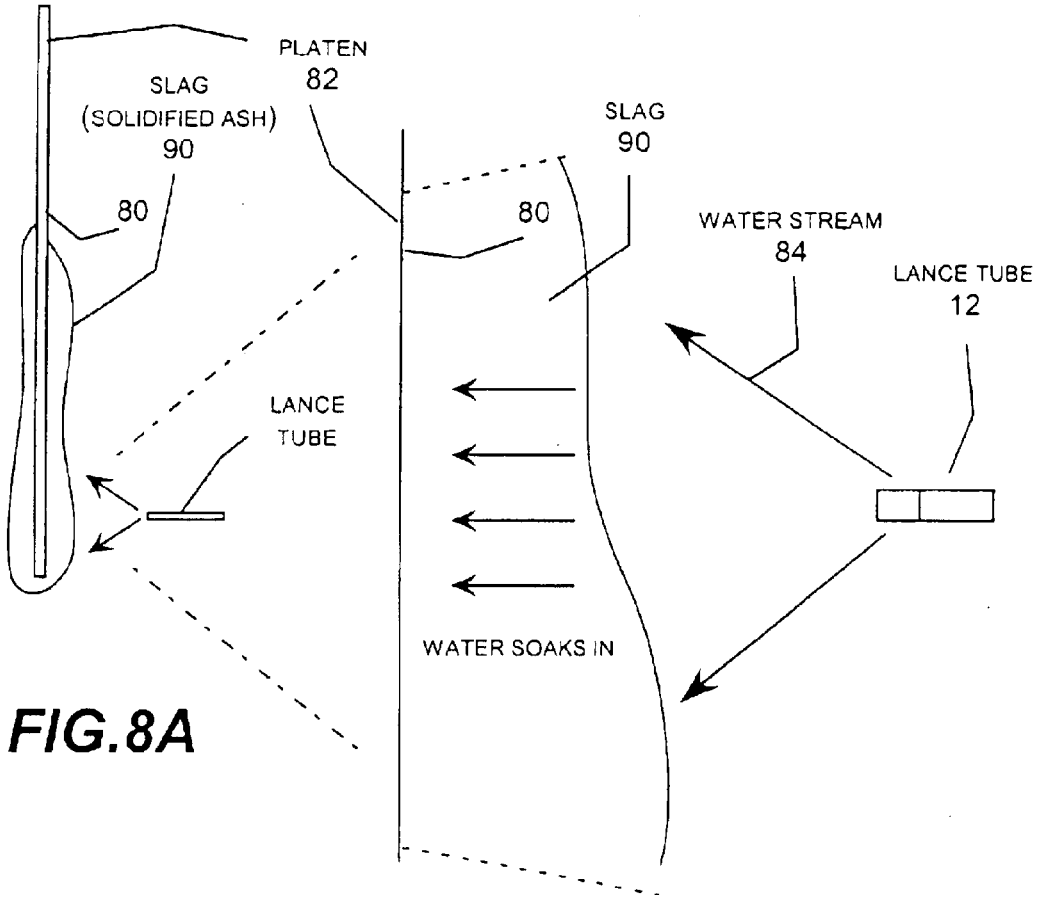
FIG. 8A is conceptual illustration of the use of water as a cleaning fluid in a slag removal process.
Figure 8B:
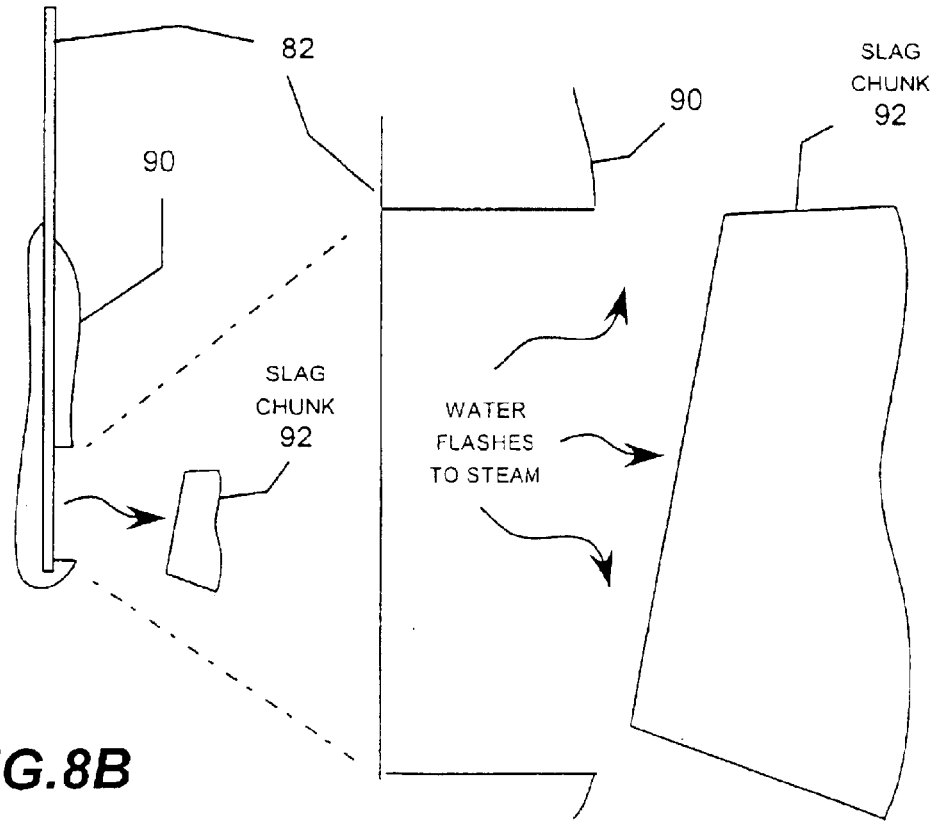
FIG. 8B is a continuation of the conceptual illustration of FIG. 8A.

FIGS. 8A–B are conceptual illustrations of the use of water as a cleaning fluid in a slag removal process. As shown in FIG. 8A, the lance 12 sprays a water stream on a slag accumulation 90. The water then soaks into the slag 90, which increases in temperature as it penetrates closer to the platen surface 80. Eventually, as shown in FIG. 8B, the water penetrates the slag 90 to a point at which it flashes to steam, which typically causes the slag to break away in fairly large chunks, as represented by the slag chunk 92. Once the chunk has been removed, the bare platen surface 80 is exposed. At this point, spraying the bare platen surface 80 with water would subject the platen to extreme and unnecessary water shock because the surface has already been successfully cleaned. To prevent such unnecessary water application, which could shorten the life of the boiler, the boiler camera 116, which may include an infrared or other sensor to detect slag removal, monitors the cleaning process, and the controller 40 uses sensor data from the boiler camera 116 to automatically discontinue cleaning of the portion of the platen surface 80 that has been successfully cleaned. This is quite important as a mechanism for avoiding unnecessary shock during the cleaning process. It should be understood that sensor data, as that term is used in this specification, may include image data from the boiler cameras as well as infrared sensor data from the boiler cameras, heat transfer data, strain gauge data, and any other sensor data that may be available from any other instruments located in or monitoring the function of the boiler.

Figure 10:
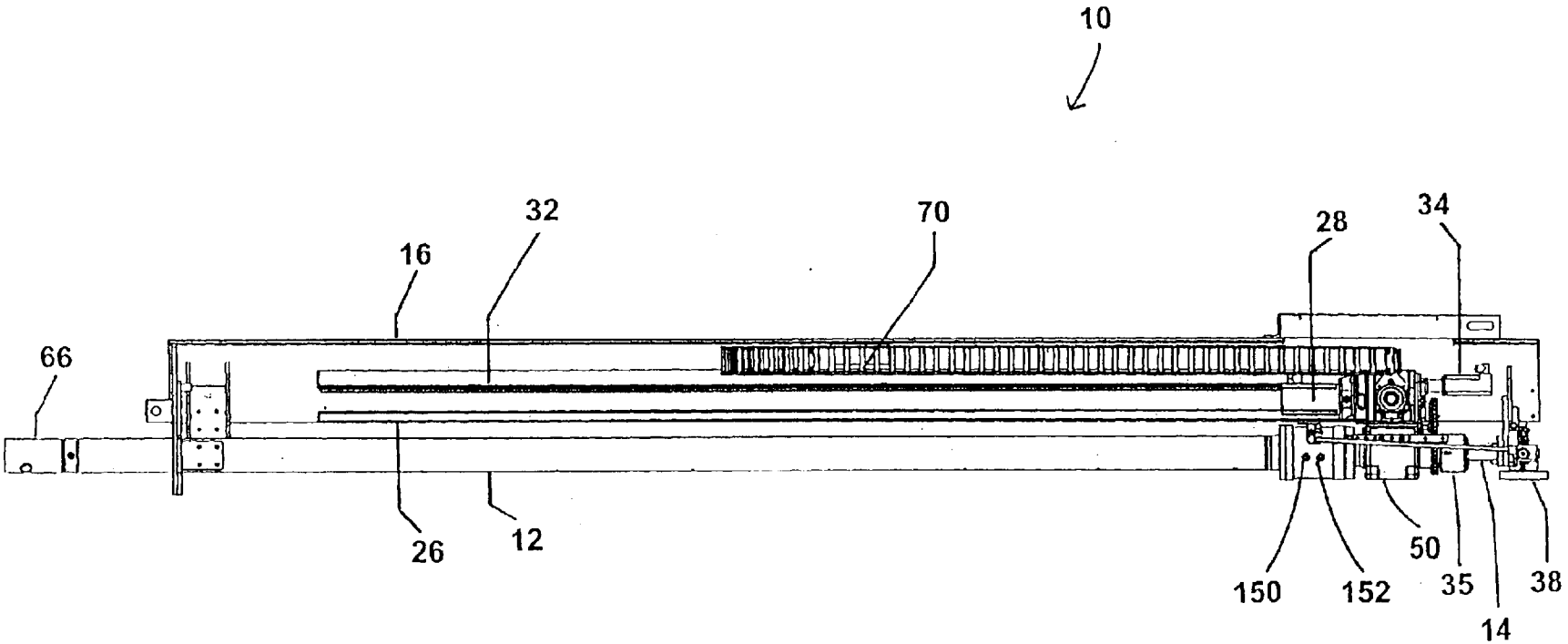
FIG. 10 is a side view of a multi-media rotating sootblower shown to scale.

FIG. 10 shows a side view of the multi-media rotating sootblower 10 with the lance 12 carrying the multi-media nozzle 66 in a fully retracted position. This view also shows the frame 16 (also called a canopy), support rail 26 and the toothed rack 32. The water distributor 50 is also shown, with water inlets 150, 152 for the water hoses 48, 58 (see FIG. 1—the hoses themselves are not shown in FIGS. 10–28 for clarity). The hose take-up tray 70 is also shown in this view, as is the steam valve 38, the linear travel motor 28, the rotation 34, and the extreme rear portion of the steam tube 14. This view also shows a packing assembly 35 that maintains a seal between the carriage 22 and the steam tube 14 to prevent steam from leaking during the cleaning operation. An exemplary packing assembly 35 is described in commonly-owned U.S. patent application Ser. No. 10/612,195, entitled "Integral Packing Housing and Packing Material Unit," filed contemporaneously with the present application, which is incorporated herein by reference. The sootblower 10 also includes an appropriate gasket between the packing assembly 35 and the spindle 190. For example, a copper gasket performs well in this application.

Figure 11:
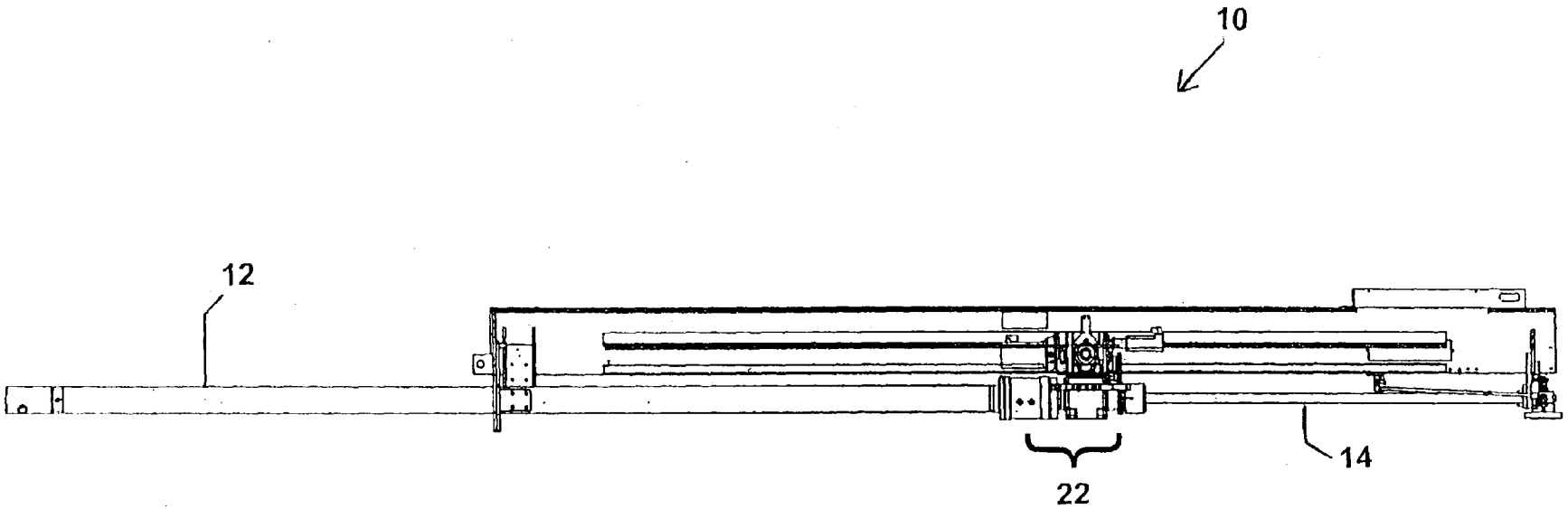
FIG. 11 is a side view of the sootblower of FIG. 10 with the lance in a partially inserted position.
Figure 12:
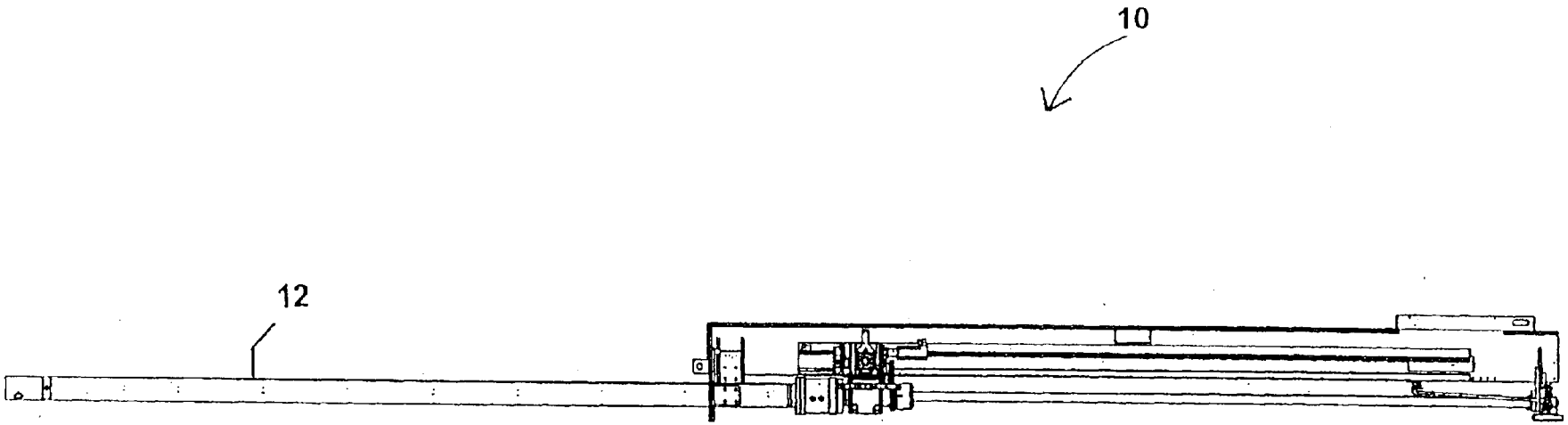
FIG. 12 is a side view of the sootblower of FIG. 10 with the lance in a fully inserted position.

FIG. 11 is a side view of the sootblower 10 with the lance 12 in a partially inserted position. This view shows the components of the carriage 22, which travels linearly along with the rear of the lance 12 as the lance telescopes along the steam tube 14. In this view, the water hoses 48, 58 and the hose take-up tray 70 have been removed to lessen the clutter of the illustration. FIG. 12 shows the sootblower 10 with the lance 12 in the fully inserted position.

Figure 13:
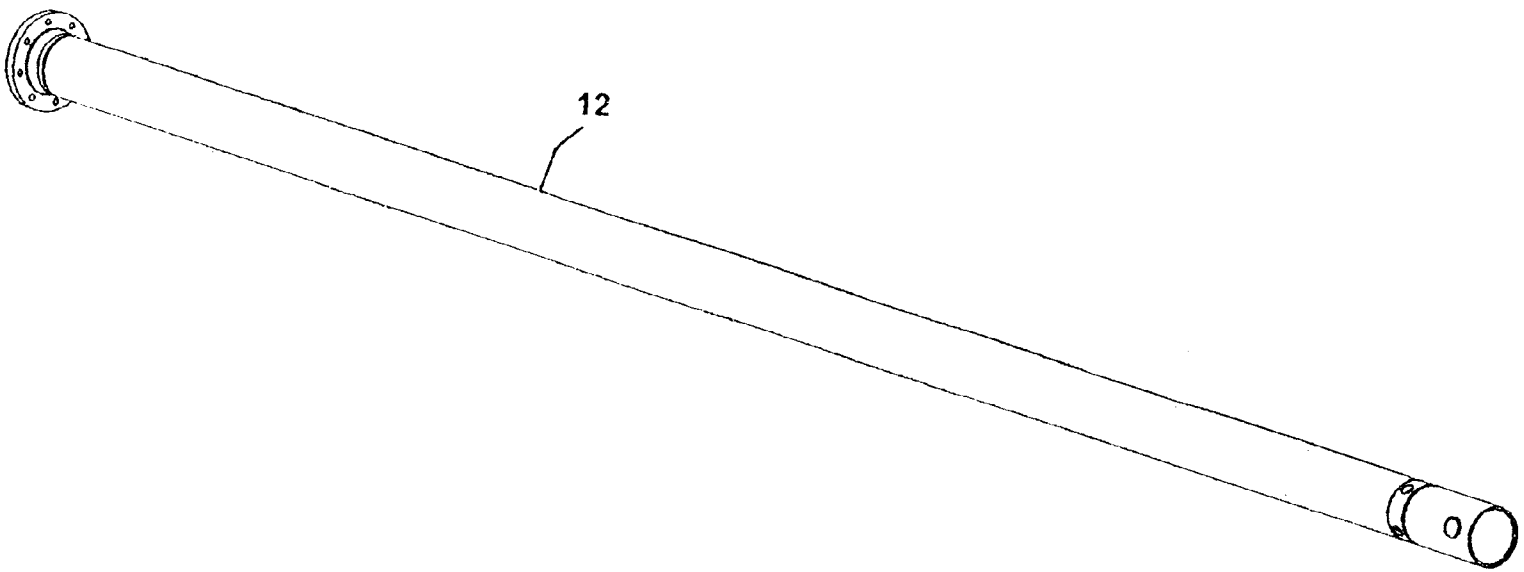
FIG. 13 is a perspective side view of the lance of the sootblower of FIG. 10.
Figure 14:
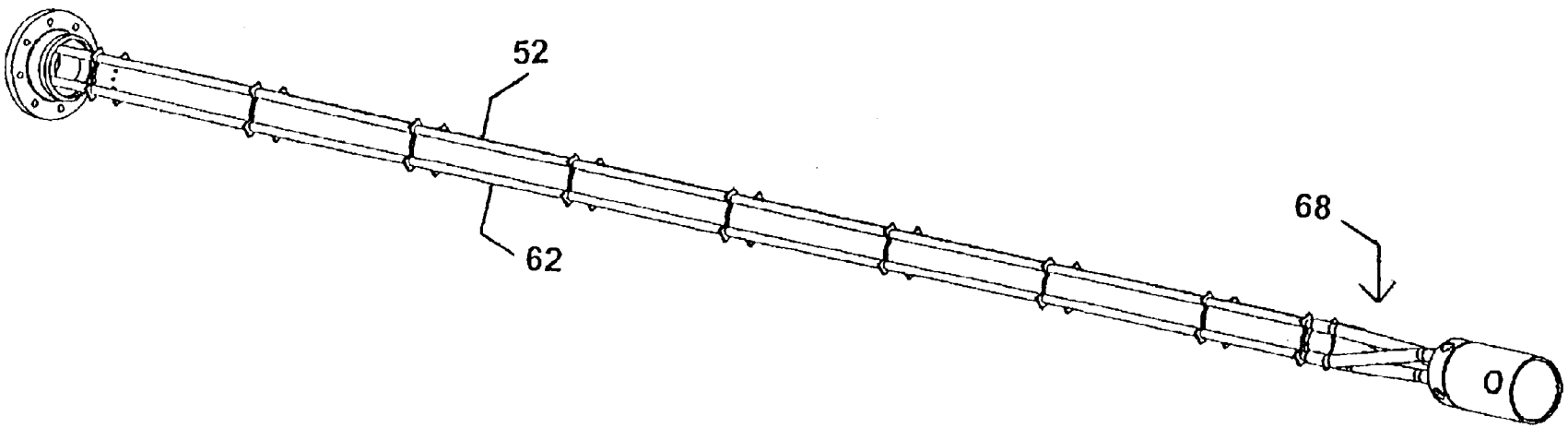
FIG. 14 is a perspective side view of the lance of FIG. 13 with the outer housing removed.

FIG. 13 is a perspective side view of the lance 12, and FIG. 14 shows the lance with the outer housing removed to reveal one of the water-1 conduits 52 and one of the water-2 conduits 62. This view also shows the flexible connectors 68, which provide the water conduits 52, 62 with length adjustment to compensate for different thermal expansion properties of the lance 12 and the water conduits. It should be appreciated that the water conduits are exposed to the temperature of steam within the lance, whereas the lance is exposed to the inter boiler temperature, which is much higher than the steam temperature. This sets up a rather severe thermal differential while the lance is operation inside the boiler. In addition, it is desirable to run steam through the lance continuously during the cleaning operation, even when water is the primary cleaning fluid being applied, because the constant steam flow cools the lance. For the same cooling purpose, and to keep ash from clogging the water nozzles, it is desirable to run air through the lance water system when steam is applied as the cleaning fluid.

Figure 15:
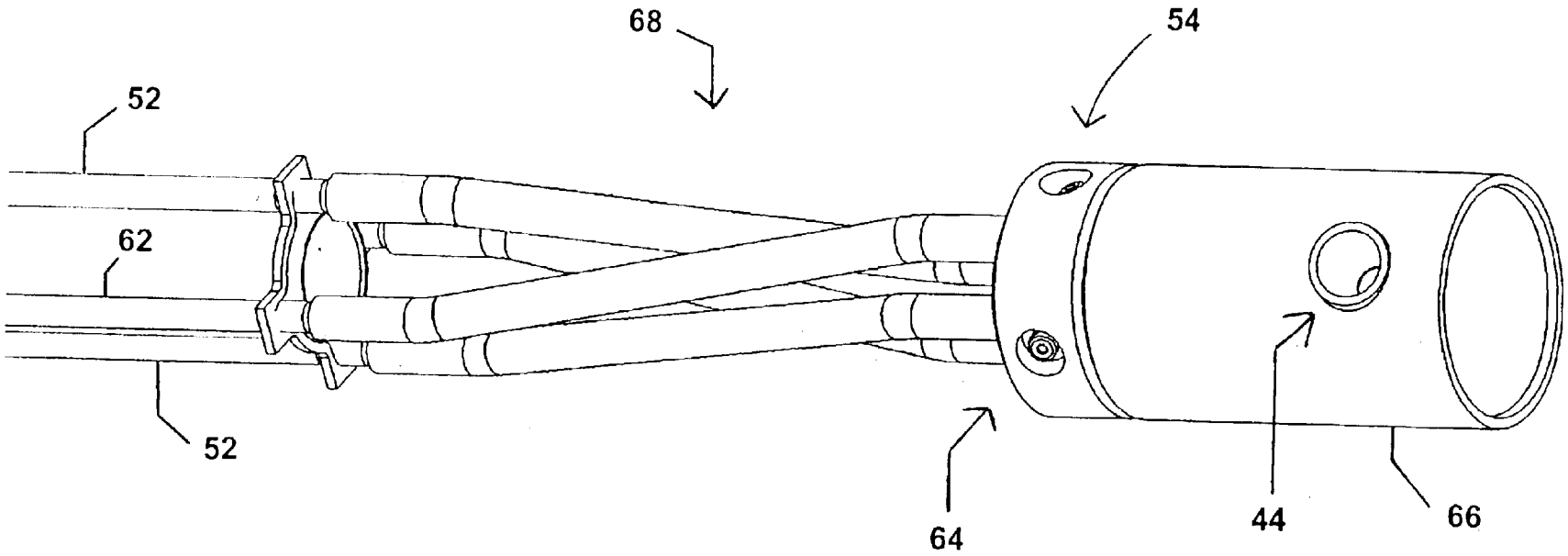
FIG. 15 is a perspective side view of the flexible connectors and nozzles located at the end of the lance of FIG. 13.
Figure 16:
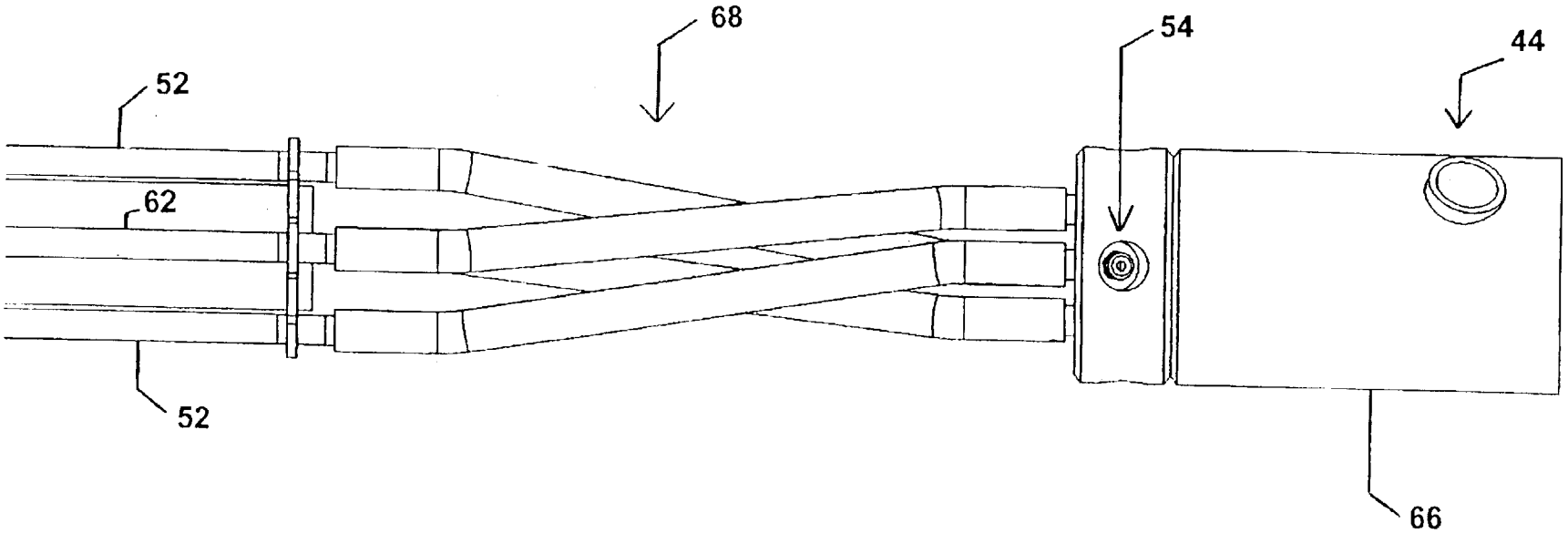
FIG. 16 is a side view of the flexible connectors and nozzles of FIG. 15.
Figure 17:
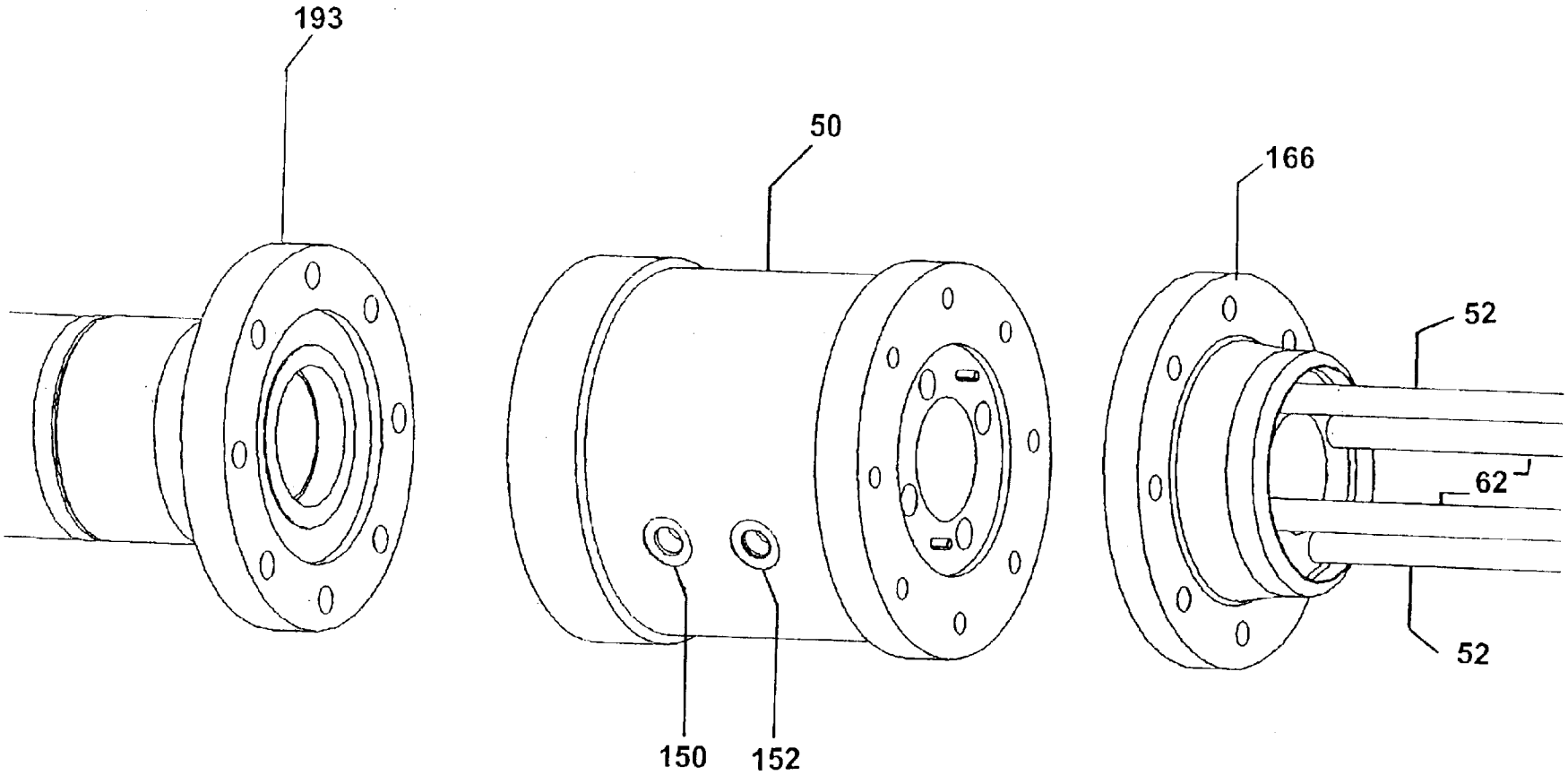
FIG. 17 is a perspective, exploded side view of the water distributor of the sootblower of FIG. 10.
Figure 18:
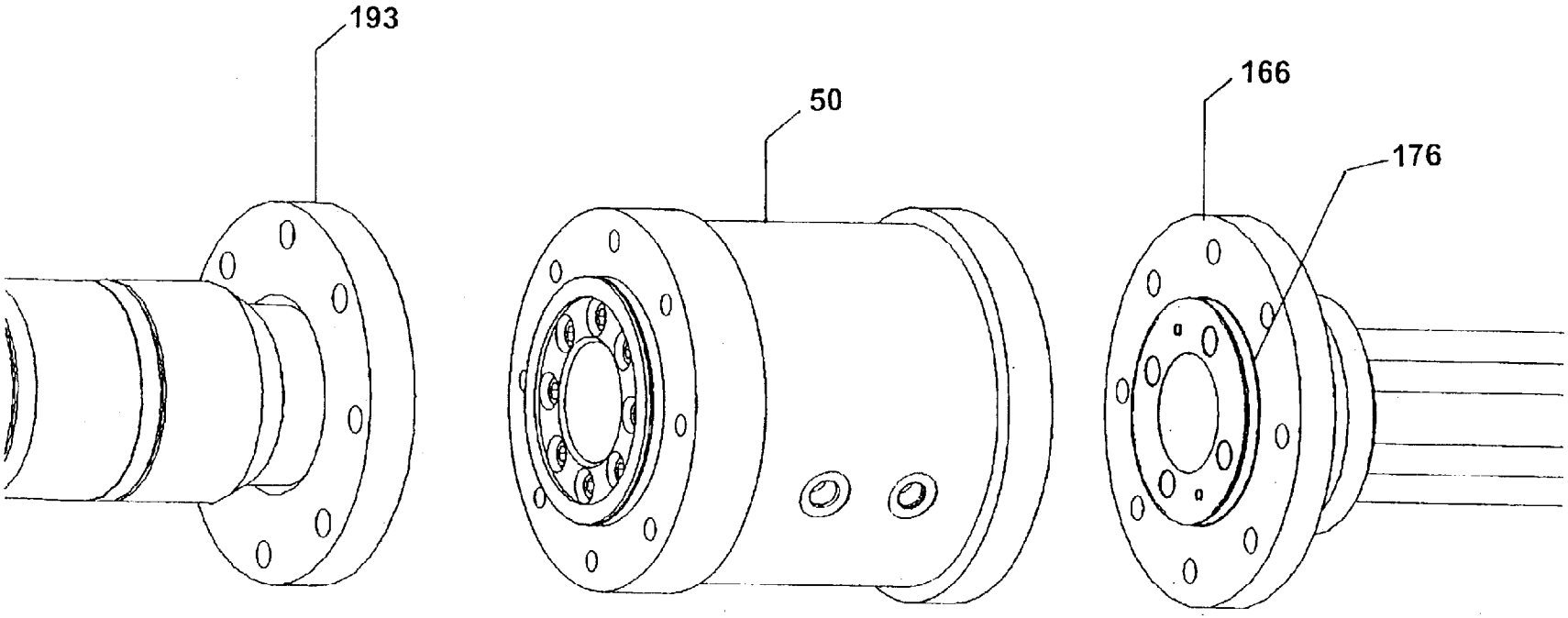
FIG. 18 is a perspective, exploded side view of the water distributor of FIG. 17 shown from a different perspective.

FIG. 15 is a perspective side view of the flexible connectors 68 and multi-media nozzle 66 located at the end of the lance 12. The steam jet 44, the water-1 jet 54 and the water-2 jet 64 are shown in this view. FIG. 16 is a side view of this same portion of the sootblower 10. FIG. 17 is a perspective, exploded side view of the water distributor 50, which delivers water received at the water-1 inlet 150 from the water-1 hose 48 to the water-1 conduits 52 while the water-1 conduits rotate with the lance 12 and the water-1 inlet remains rotationally stationary. Similarly, the water distributor 50 delivers water received at the water-2 inlet 152 from the water-2 hose 58 to the water-2 conduits 62 while the water-2 conduits rotate with the lance 12 and the water-2 inlet remains rotationally stationary. FIG. 18 shows the water distributor 50 from a different perspective.

Figure 19:
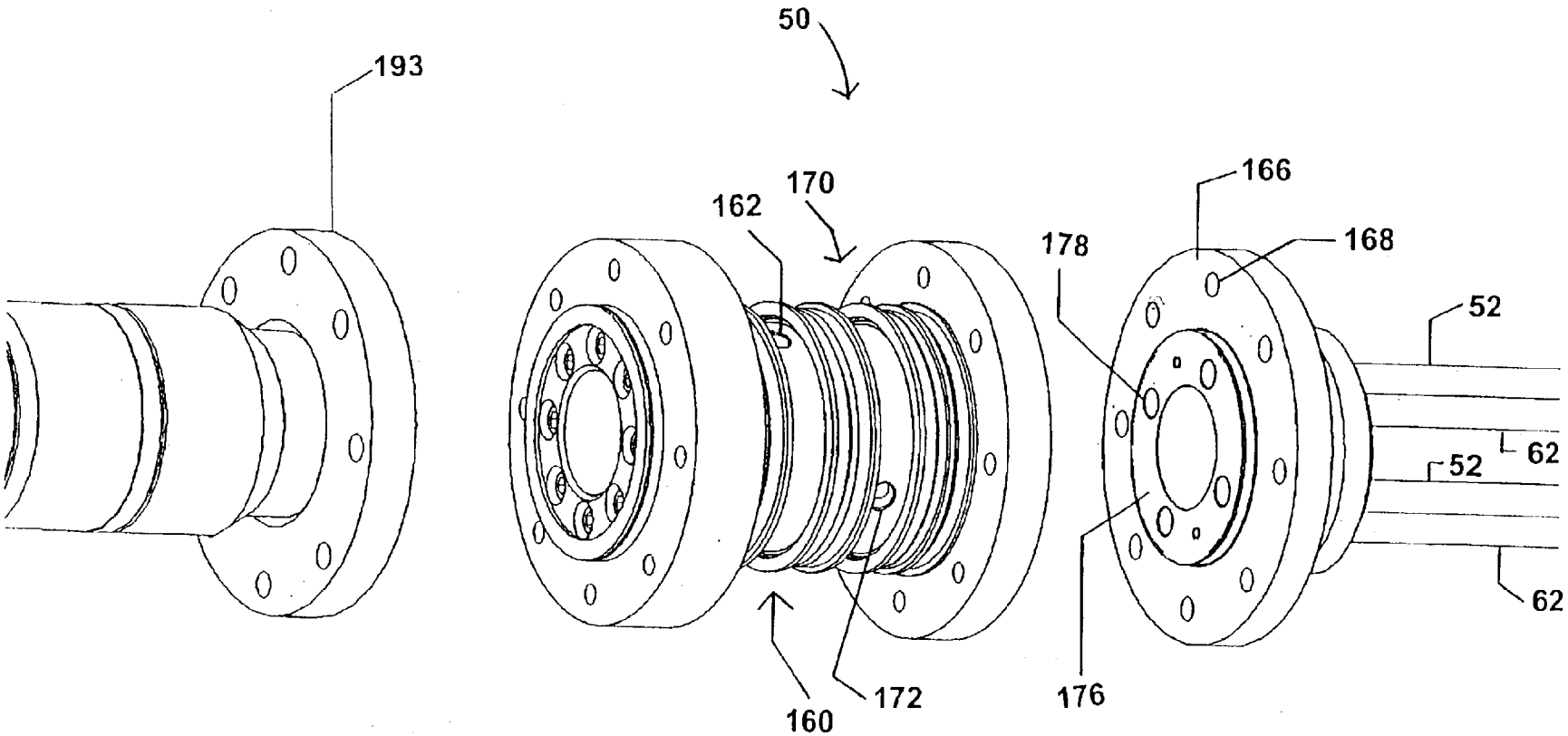
FIG. 19 is a perspective, exploded side view of the water distributor of FIG. 17 with the outer housing of the water distributor removed.
Figure 20:
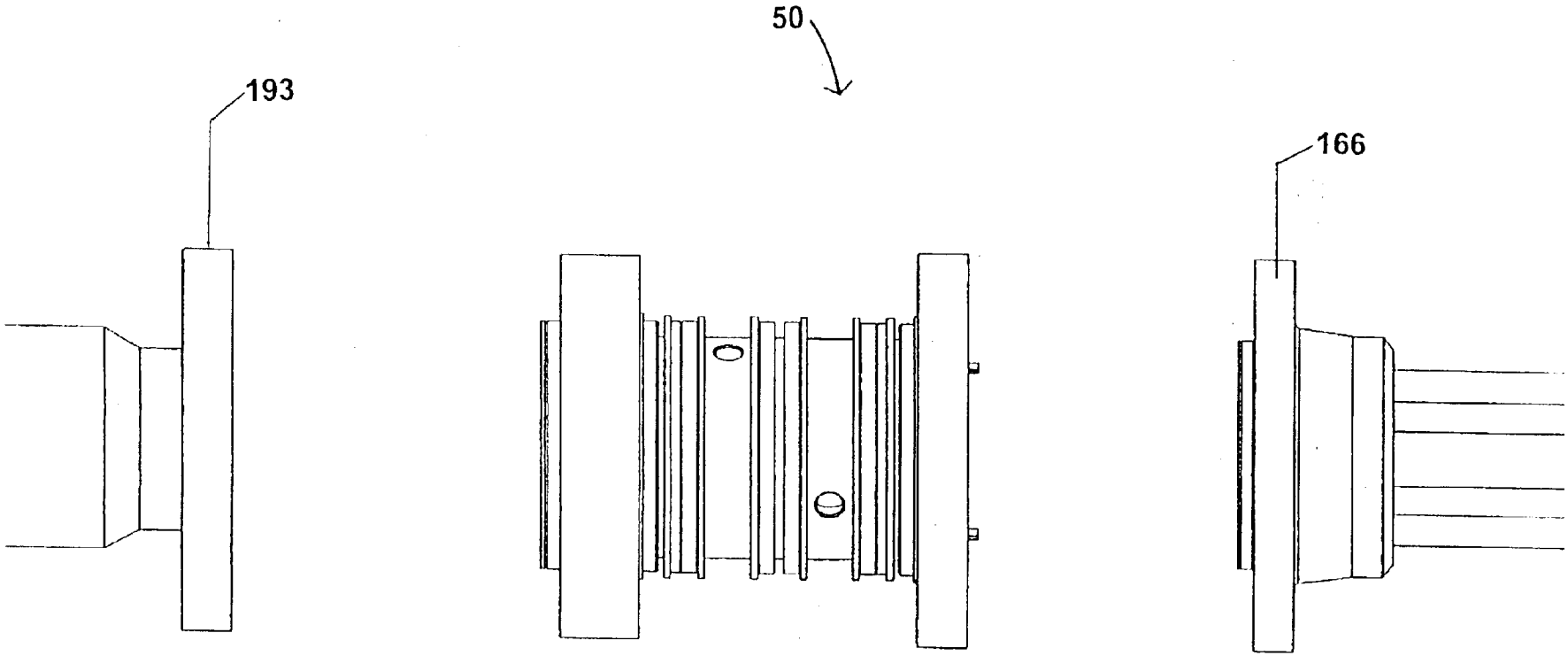
FIG. 20 is an exploded side view of the water distributor of FIG. 17 with the outer housing of the water distributor removed.

FIG. 19 shows the water distributor 50 with the outer housing removed, which reveals a first water supply channel 160 that becomes pressurized with water supplied by the water-1 hose 48 through the water-1 inlet 150. Water within the first water supply channel 160 is forced through an opening 162 into a first pair of internal conduits 180 (shown in FIG. 21) that are fluidly connected to the flange 166, which includes openings 168 that are fluidly connected to the water-1 conduits 52. This allows the water-1 conduits 52 to be pressurized with water received at the water-1 inlet 150 while the water-1 conduits rotate with the lance 12 and the water-1 inlet remains rotationally stationary. Similarly, a second water supply channel 170 becomes pressurized with water supplied by the water-2 hose 58 through the water-2 inlet 152. Water within the second water supply channel 170 is forced through an opening 172 into a second pair of internal conduits 182 (shown in FIG. 22) that are fluidly connected to the flange 176, which includes openings 178 that are fluidly connected to the water-2 conduits 62. This allows the water-2 conduits 62 to be pressurized with water received at the water-2 inlet 152 while the water-2 conduits rotate with the lance 12 and the water-1 inlet remains rotationally stationary. FIG. 20 is a side view of this same structure.

Figure 21:
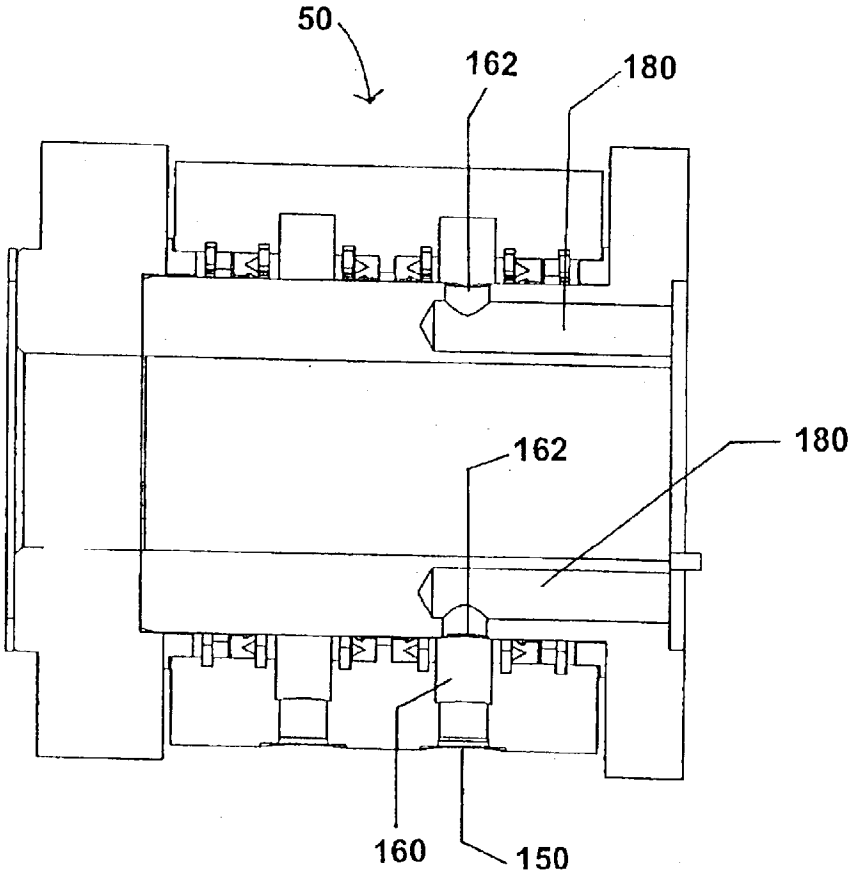
FIG. 21 is side crosssection view of the water distributor of FIG. 17 showing a first water channel in fluid communication with a first set of water conduits.
Figure 22:
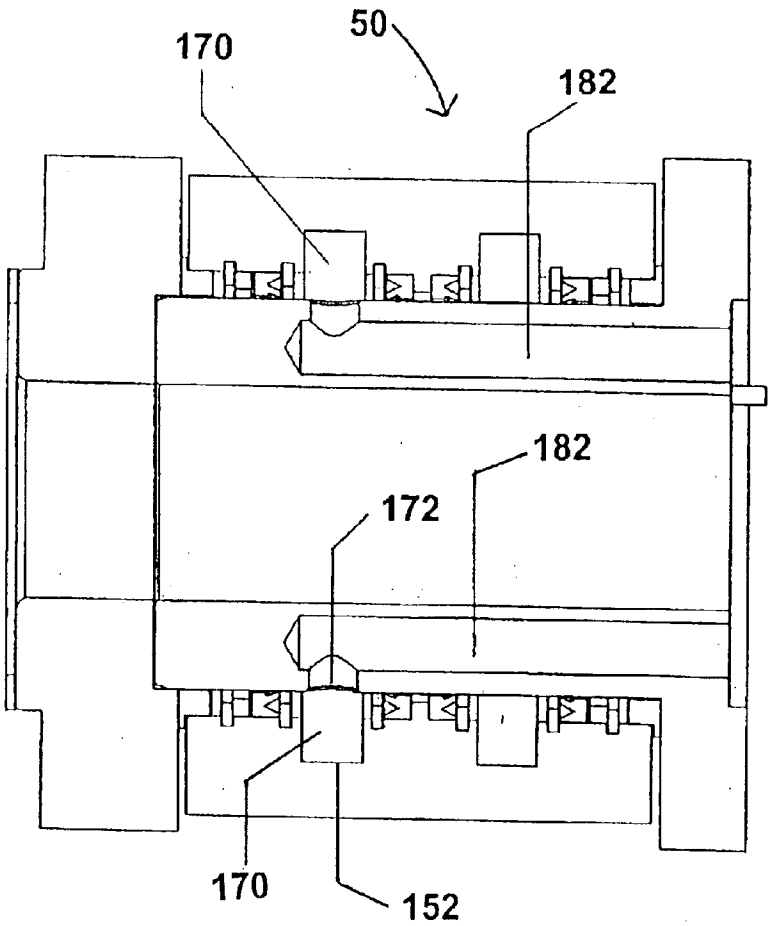
FIG. 22 is a side crosssection view of the water distributor of FIG. 21 showing a second water channel in fluid communication with a second set of water conduits.
Figure 23:
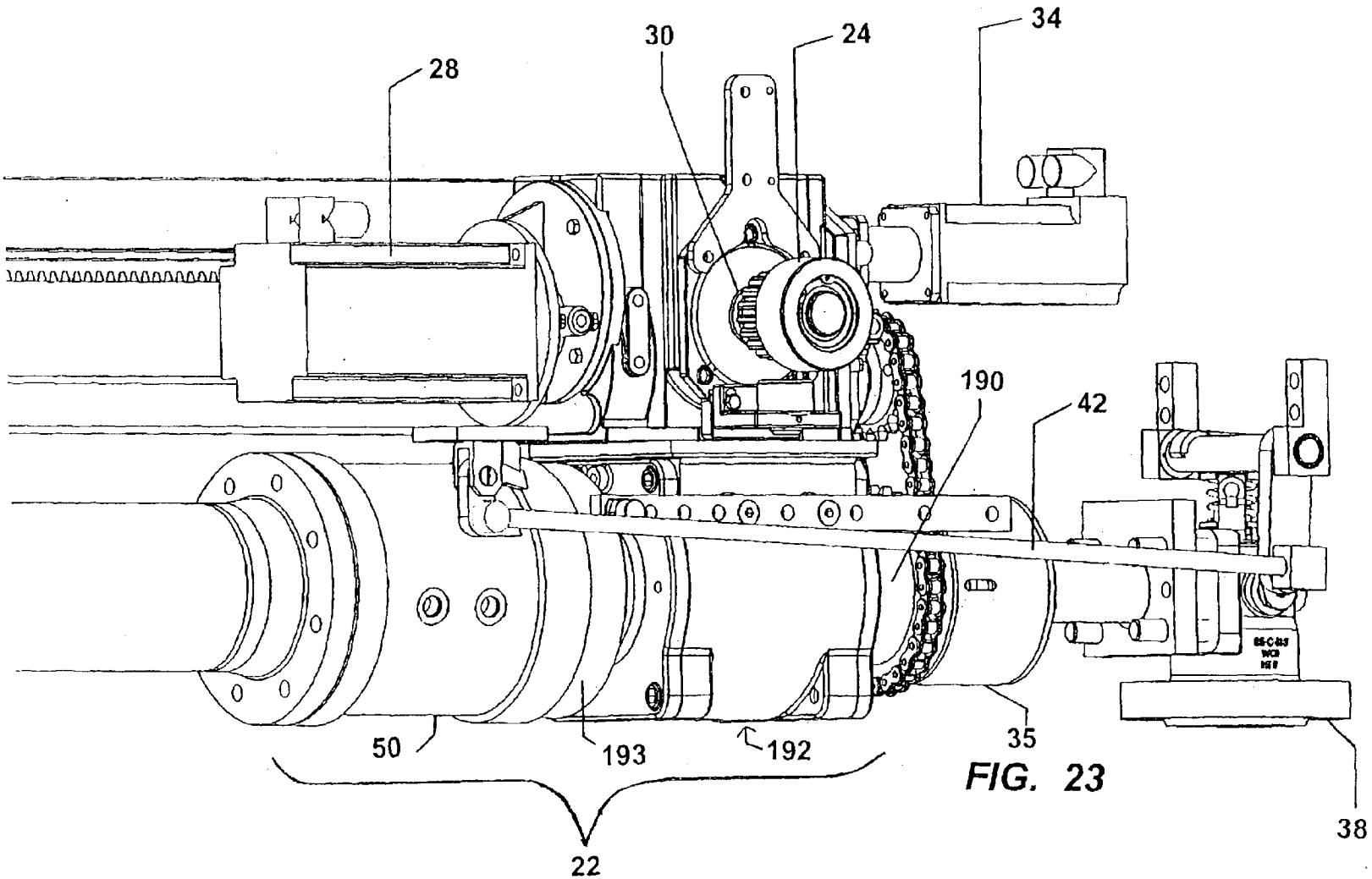
FIG. 23 is perspective view of the carriage of the sootblower of FIG. 10.
Figure 24:
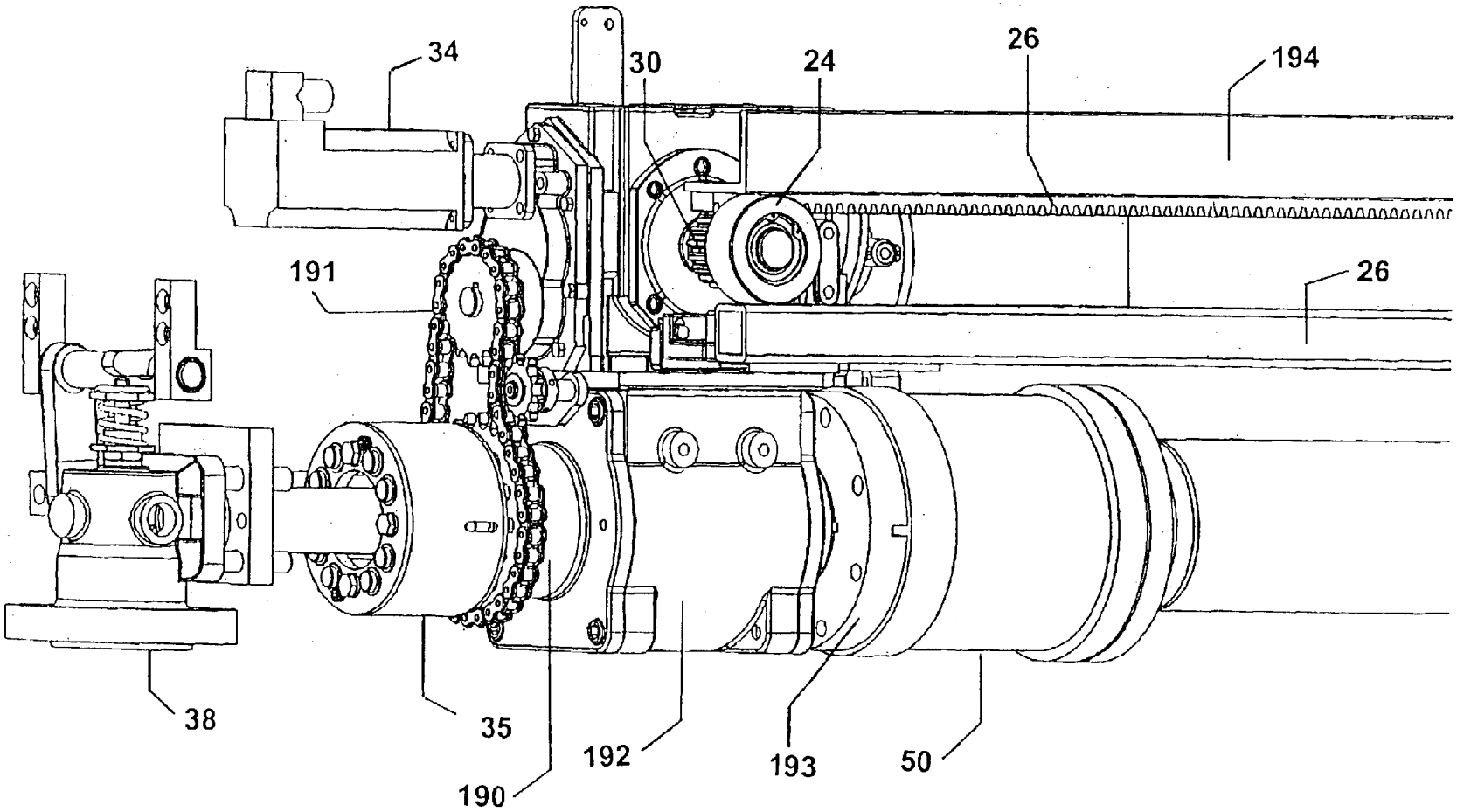
FIG. 24 is perspective view of the other side of the carriage of FIG. 23.

FIG. 21 is side crosssection view of the water distributor 50, which illustrates the water-1 inlet 150 in fluid communication with the first water supply channel 160, which is fluidly connected with the first pair of internal conduits 180, which supply water to the water-1 conduits 54. Similarly, FIG. 22 is side crosssection view of the water distributor 50 showing the water-2 inlet 152 in fluid communication with the second water channel 170, which is fluidly connected with the second pair of internal conduits 182, which supply water to the water-2 conduits 64. FIG. 23 is perspective view of the carriage 22 of the sootblower 10. This view shows a more detailed view of the water distributor 50, the packing assembly 35, the steam valve 38, the linkage 42, the linear travel motor 28, the rotation motor 34, the roller 24 and the pinion gear 30. This view also shows a chain linkage assembly 191 that translates rotation of the rotation motor 34 to a spindle 190 (shown better in FIG. 25) located within a spindle housing 192 at the end of the lance 12, which rotationally drives the lance. FIG. 24 is perspective view of the other side of the carriage 22, which shows the same components from the other side. This view also shows spindle flange 193 that connects the spindle 190 to the rotating inner sleeve of the water distributor 50. This view also shows an angle bar 194 that mounts the rack 24 to the frame 16 (not shown in this view).

Figure 25:
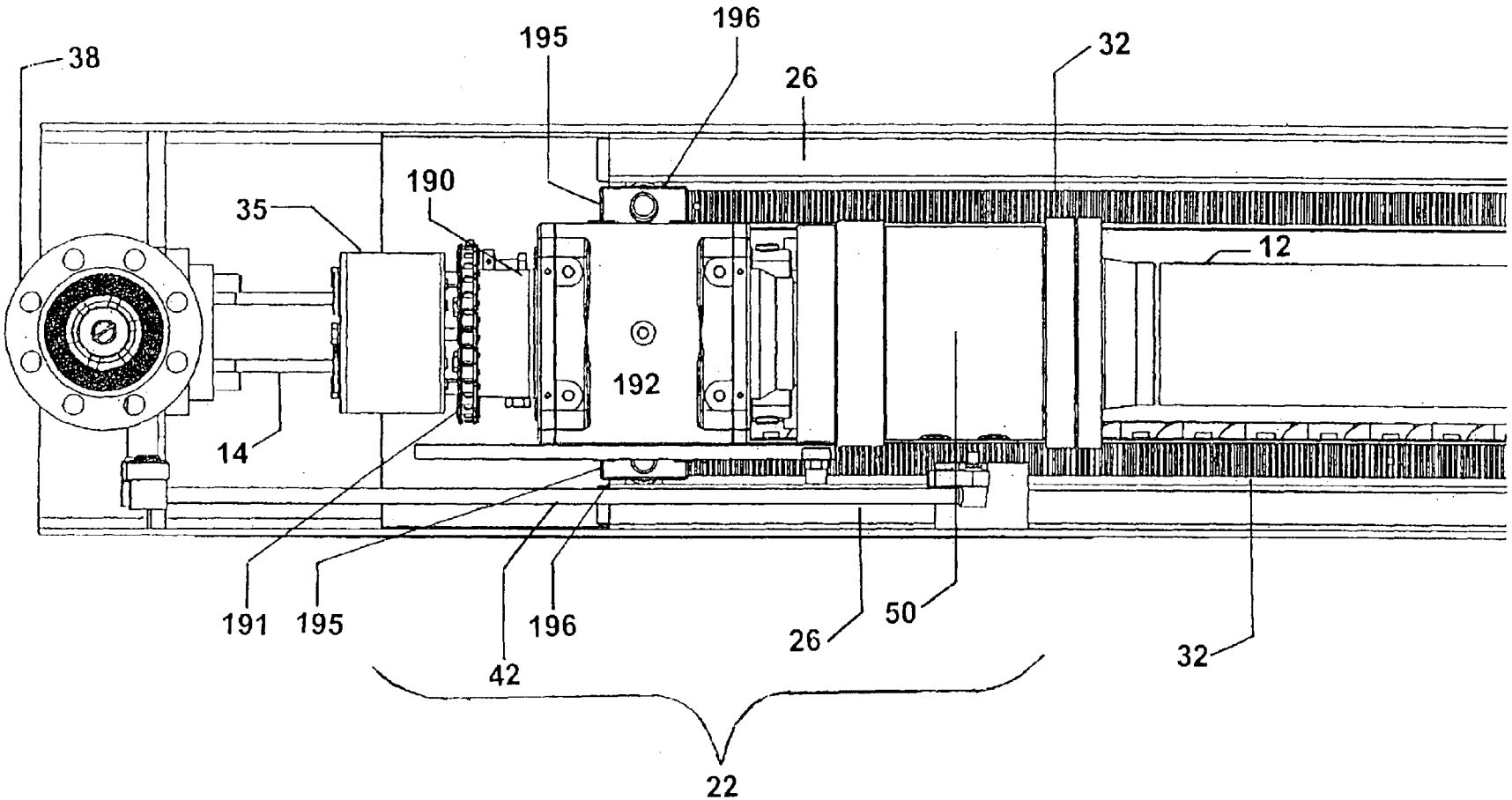
FIG. 25 is bottom view of the carriage of FIG. 23.
Figure 26:
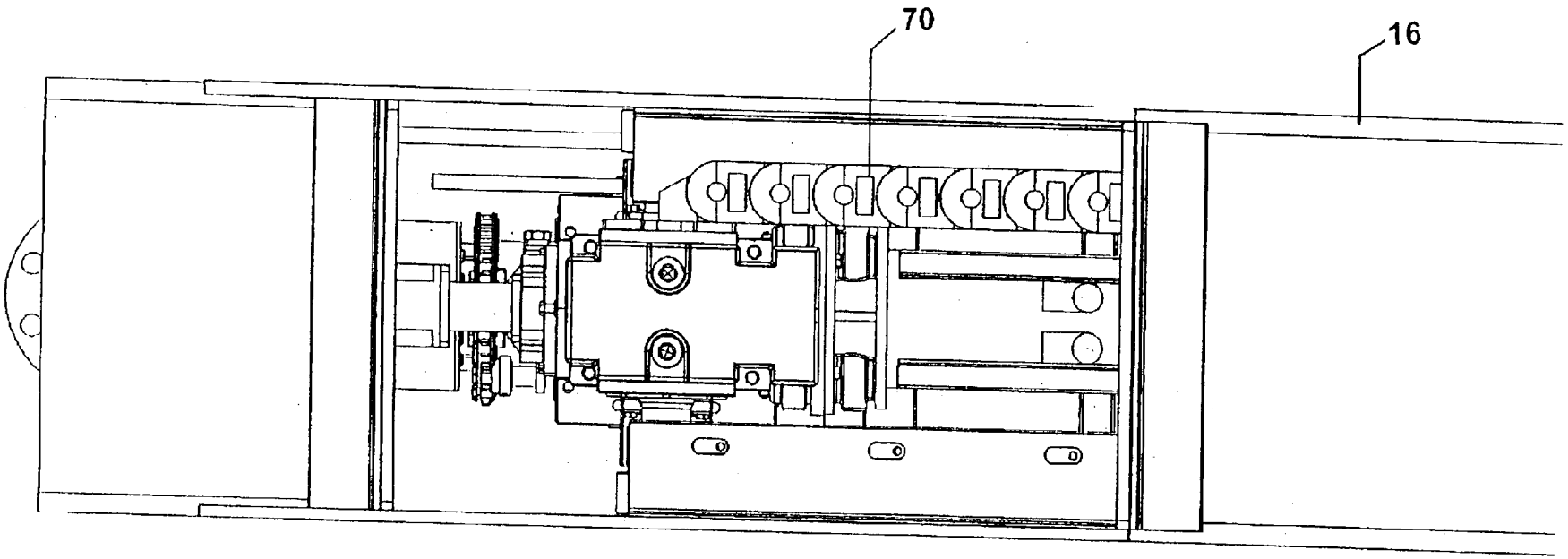
FIG. 26 is top view of the carriage of FIG. 23.
Figure 27:
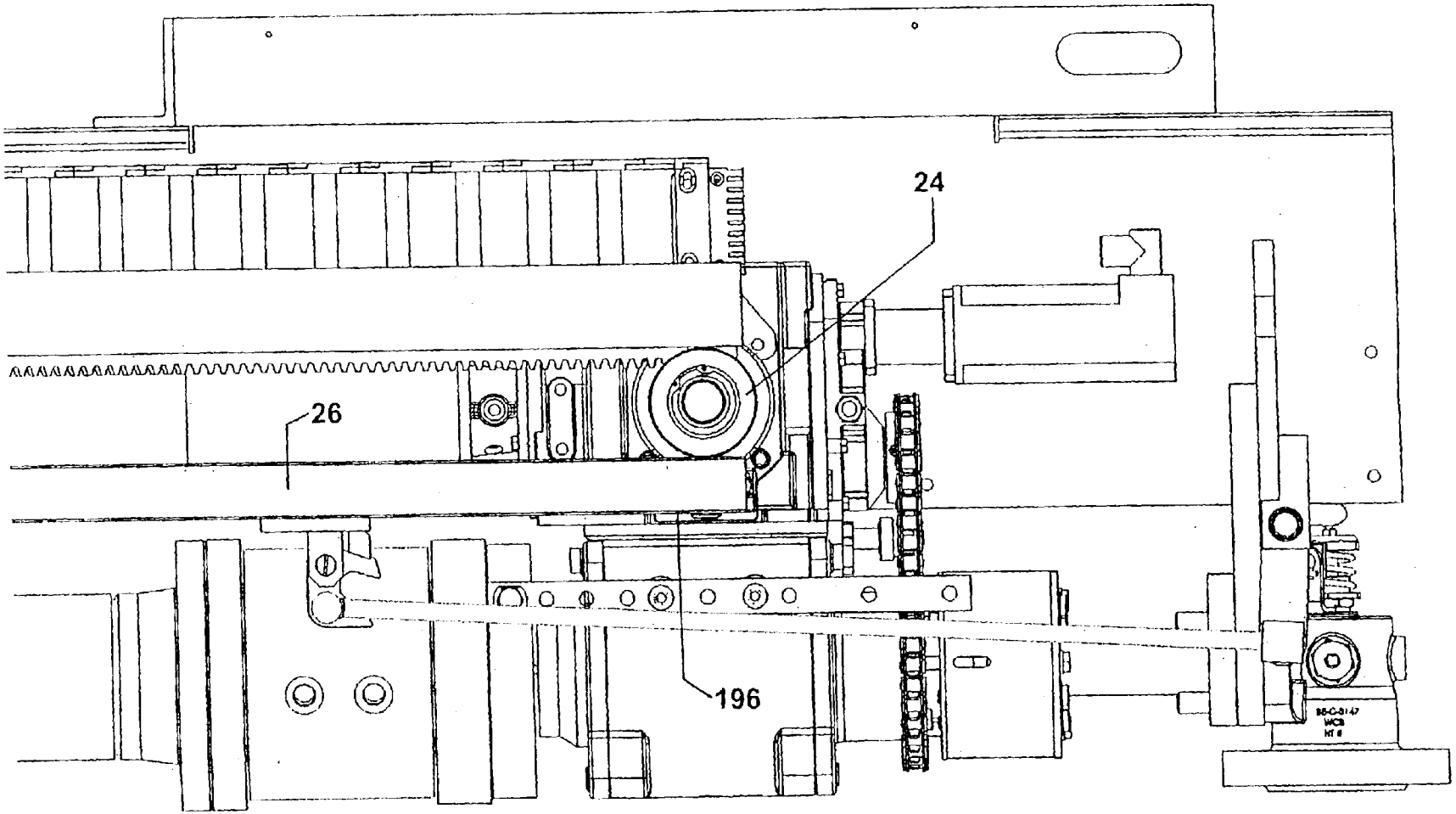
FIG. 27 is side view of the drive system of the sootblower of FIG. 10.
Figure 28:
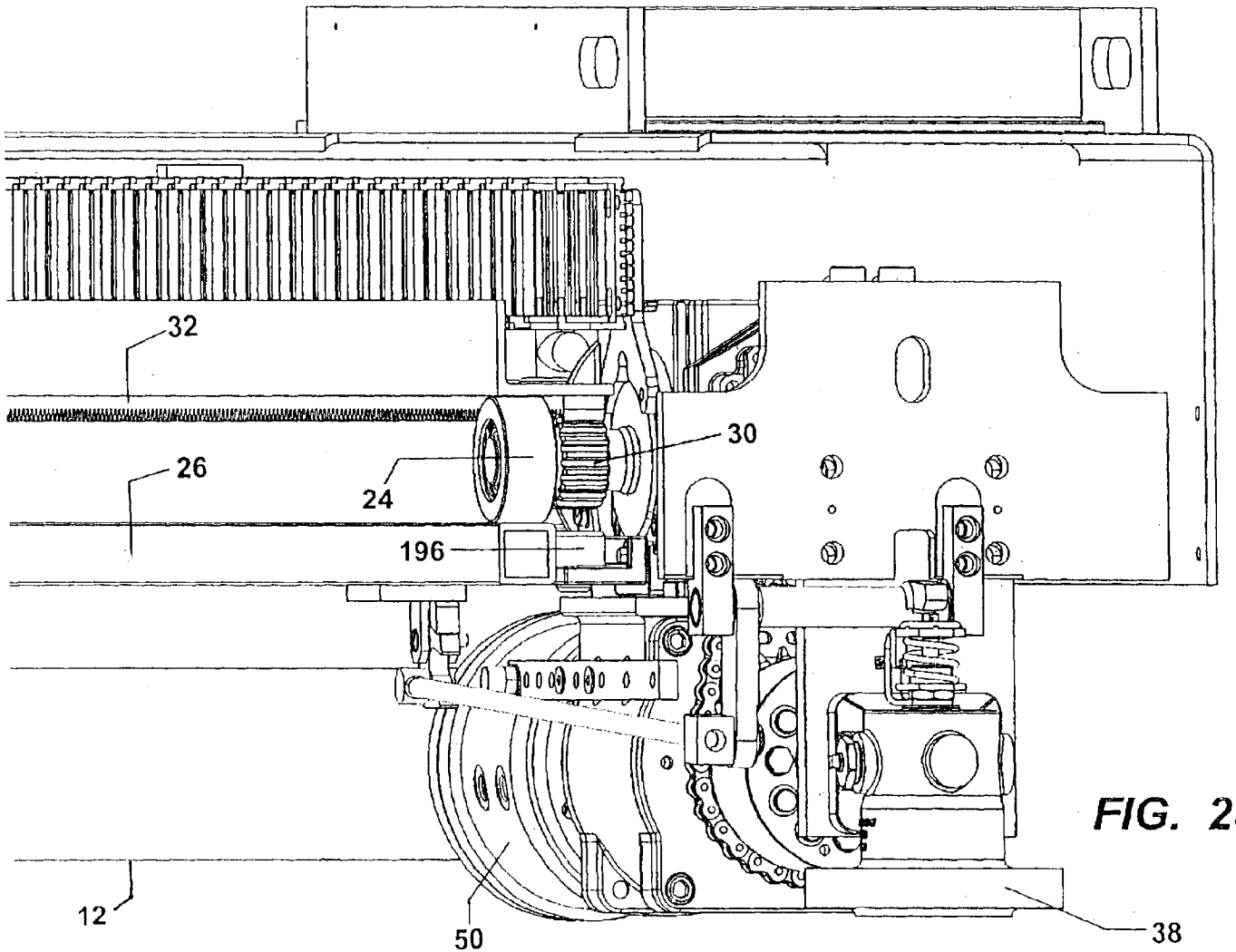
FIG. 28 is perspective rear view of the drive system of FIG. 27.

FIG. 25 is bottom view of the carriage 22, which shows that there are two rails 26 and two racks 32 guiding the linear travel of the carriage. This view also shows the spindle 190 and the spindle housing 192 as well as two side roller supports 195 that support two side rollers 196 that ride against the inner sides of the guide rails 26 to limit lateral movement of the carriage 22. FIG. 26 is top view of the carriage 22, which provides a view of a portion of the hose take-up tray 70 and the frame 16. FIG. 27 is side view of the drive system of the sootblower 10, which provides a more detailed view of the rail 26, the roller 24 and the side roller 196 as they interact in the drive system. FIG. 28 is perspective rear view of the drive system of the sootblower 10, which shows the support rail 26, roller 24 and side roller 196, as well as the rack 32 and pinion gear 30.

All of the following parameters are for a typical commercial sootblower 10 as shown and described with reference to FIGS. 10–28. These particular parameters may be varied for particular applications. The length of the lance tube 12 is about the same as the frame 16, the steam tube 14, the support rail 26 and the toothed rack 32, which all correspond to the desired insertion length of the lance tube into the boiler. This length may vary from boiler to boiler, and may also vary from location to location within a particular boiler. Lance lengths of 10 feet [3 m] to over 50 feet [15 m] are not uncommon. The steam supply 36, which has been used in sootblowers for years, may be any conventional industrial process steam, which is typically applied with a nozzle velocity above the speed of sound. The water-supply 46 is typically in the area of 20 to 100 GPM [750 to 3,750 $cm^3$/min] at pressures around 100 to 500 PSI [7 to 35 $kg/cm^2$].

The frame 16 is typically constructed from formed carbon steel plates. The lance tube 12 is typically constructed from ⅛ to ½ inches [3.2 to 12.7 mm] thick steel tubing 5 to 6 inches [125 to 150 mm] in diameter. The steam tube 14 is typically constructed from 0.188 inches [4.8 mm] side-wall steel tubing 2⅜ to 2¾ inches [60 to 70 mm] in diameter. The water hoses 46, 56 are standard ¾ inches [19 mm] diameter high-pressure hose, such as model number 100R12 manufactured by Ryco. The water conduits 52, 62 are typically constructed from 0.035 inches [0.89 mm] side-wall steel tubing ¾ inches [19 mm] inches in diameter, and the flexible links 68 are typically ¾ inches [19 mm] corrugated steel tube wrapped by steel mesh, such as model number UFBX1 manufactured by Senior Flexonics.

The rotation motor 34 and the linear travel motor 28 may be a brushless DC servo motor, such as the PMA57R model manufactured by Pacific Scientific providing a 195 lb-in (22.0 Nm) continuous torque. The hose take-up tray 70 may be a model number 340-100-150 manufactured by Igus. The roller 24, the pinion gear 30, and the rack are a custom manufactured items milled from steel. The controller 40 may be any suitable type of industrial programmable logic type controller, such as a the ControlLogix models manufactured by Allen Bradley. For boilers operating with positive pressure, the pneumatic fan 302 may be a Becker type SV 7.330 rated for 60 Hz, 230/400 V, 4.8 KW. This fan will be suitable, but a somewhat smaller fan may be specified for boilers operating with negative pressure.

The steam valve 38 may be a typical, mechanically or pneumatically operated shut off valve as commonly used on sootblowers and manufactured from cast steel, and the water valves 55, 65 may be model number VSV-F 50 NC manufactured by COAX. The multi-media nozzle is a custom manufactured item, which is typically manufactured from heat resistant stainless steel milled to the desired specifications and welded or threaded into to the end of the lance tube 12. The carriage 22 is a also custom manufactured item, which is typically manufactured form cast iron milled to the desired specifications. The wall box 20 is another custom manufactured item, and consist of an outer tube and a sealing device, such as a conventional pressure-loaded packing. The linkage 42 is a standard item that has been included on conventional steam sootblowers for may years.

In view of the foregoing, it will be appreciated that present invention provides significant improvements in sootblowers and automatic boiler cleaning systems and that numerous changes may be made therein without departing from the spirit and scope of the invention as defined by the following claims.

The invention claimed is:

1. A sootblower for cleaning internal components of an industrial boiler while the boiler is in operation, comprising:

a lance tube simultaneously carrying at least two separately controlled cleaning fluid applicators, the lance tube rotating as it delivers the separately controlled cleaning fluids to clean the interior components of the boiler;

a drive system for linearly inserting the lance tube into and retracting the lance tube from the boiler while rotating the lance tube; and a control system for controlling the delivery of the cleaning fluids including turning on or off each separately controlled cleaning fluid applicator without have to install a device on or remove a device from the lance tube.

2. The sootblower of claim 1, wherein a first cleaning fluid comprises steam, further comprising:

a steam tube on which the lance tube is telescopically received, the steam tube configured to deliver steam into an interior cavity of the lance tube;

one or more steam nozzles in fluid communication with the interior cavity of the lance tube for directing the steam out of the lance tube and into the boiler interior;

a steam valve for controlling the delivery of steam to the steam tube; and a carriage propelled by the drive system for telescopically inserting the lance tube into and retracting the lance tube from the boiler while the lance tube rotates and the steam tube remains stationary.

3. The sootblower of claim 2, wherein a second cleaning fluid comprises water, further comprising:

one or more water conduits located within the interior cavity of the lance tube;

one or more water nozzles in fluid communication with the water conduits for directing a water stream out of the lance tube and into the boiler interior;

a water distributor carried by the carriage for delivering water from a water supply device to the water conduits while the water conduits rotate with respect to the water supply device; and a water valve for controlling the deliver of water to the water distributor.

4. The sootblower of claim 3, further comprising a flexible link between each water conduit and an associated water nozzle to adjust for different thermal expansion properties exhibited by the lance tube and the water conduits.

5. The sootblower of claim 3, further comprising:

a first separately controlled water valve, water conduit and water nozzle system that is pointed toward the direction of lance insertion; and a second separately controlled water valve, water conduit and water nozzle system that is pointed toward the direction of lance retraction.

6. The sootblower of claim 3, further comprising:

a rotation motor carried by the carriage for rotating the lance tube;

a linear travel motor carried by the carriage for inserting the lance into and retracting the lance from the boiler interior;

a frame supporting the steam tube and a toothed rack and a rail;

a roller coupled to the carriage and riding on the rail for supporting the linear travel of the carriage; and a pinion gear driven by the linear travel motor and engaged with the rack for driving the linear travel of the lance tube.

7. The sootblower of claim 6, wherein the water supply device comprises one or more water hoses for delivering the water to the water distributor, further comprising a hose take-up tray supported by the frame and providing a folding linkage supporting the water hoses as the carriage moves along the steam tube.

8. The sootblower of claim 3, wherein the control system comprises a strain gauge measuring the accumulation of ash deposits on an interior boiler component and automatically triggering operation of the sootblower to clean the component upon detection of a predetermined level of accumulation.

9. The sootblower of claim 3, wherein the control system is configured to control the rotation and linear motion of the lance tube to apply a substantially constant progression of the water stream as it contacts an internal boiler component.

10. The sootblower of claim 9, wherein the control system comprises a camera viewing the interior boiler component and automatically discontinuing operation of the sootblower to clean a portion of the component upon detection of successful cleaning.

11. A sootblower for cleaning internal components of an industrial boiler while the boiler is in operation, comprising:

a lance tube having at least two separately controlled water applicators, the lance rotating as it delivers water streams from the separately controlled water applicators to clean interior components of the boiler;

a drive system for linearly inserting the lance tube into and retracting the lance tube from the boiler while rotating the lance tube; and a control system for controlling the rotation and linear motion of the lance tube to apply a substantially constant progression of the first water stream as it contacts a planar face of a platen positioned perpendicular to the direction of linear motion of the lance as the lance is inserted into the boiler; and the control system further configured to control the rotation and linear motion of the lance tube to apply a substantially constant progression of the second water stream as it contacts an opposing planar face of the platen as the lance is retracted from the boiler.

12. The sootblower of claim 11, wherein the control system comprises a strain gauge measuring the accumulation of ash deposits on the platen and automatically triggering operation of the sootblower to clean the platen upon detection of a predetermined level of accumulation.

13. The sootblower of claim 12, wherein the control system comprises a camera viewing the platen and automatically discontinuing operation of the sootblower to clean a portion of the platen upon detection of successful cleaning.

14. A sootblower for cleaning internal components of a power plant boiler while the boiler is in operation, comprising:

a frame supporting a steam tube, a toothed rack and a rail;

a lance tube telescopically received on the steam tube, which is configured to deliver steam into an interior cavity of the lance tube;

one or more steam nozzles in fluid communication with the interior cavity of the lance tube for directing the steam out of the lance tube and into the boiler interior;

a steam valve for controlling the delivery of steam to the steam tube;

a carriage configured to telescopically move the lance tube with respect to the steam tube to insert the lance tube into and retract the lance tube from the boiler while the lance tube rotates and the steam tube remains stationary;

first and second water conduits located within the lance tube;

a first water nozzle in fluid communication with the first water conduit for directing a water stream out of the lance tube and into the boiler interior;

a second water nozzle in fluid communication with the second water conduit for directing a water stream out of the lance tube and into the boiler interior;

a water distributor carried by the carriage and having a first pressurized water channel for delivering water from a first water hose to the first water conduit while the first water conduit rotates with respect to the water hose, a first water valve for controlling the deliver of water to the first water conduit, a second pressurized water channel for delivering water from a second water hose to the second water conduit while the water conduit rotates with respect to the water hose, and a second water valve for controlling the deliver of water to the second water conduit;

a rotation motor carried by the carriage for rotating the lance tube while the lance travels along the steam tube;

a linear travel motor carried by the carriage for driving inserting the lance into and retracting the lance from the boiler interior;

a roller coupled to the carriage and riding on the rail for supporting the linear travel of the carriage;

a pinion gear driven by the linear travel motor and engaged with the rack for driving the linear travel of the lance tube; and a control system for simultaneously controlling rotation of the lance, linear travel of the lance, delivery of the steam, delivery of water from the first set of water nozzles, and delivery of water from the second set of water nozzles.

15. The sootblower of claim 14, further comprising a flexible link between each water conduit and an associated water nozzle to adjust for different thermal expansion properties exhibited by the lance tube and the water conduits.

16. The sootblower of claim 14, further comprising a hose take-up tray supported by the frame and providing a folding linkage to support the first and second water hoses as the carriage moves along the steam tube.

17. The sootblower of claim 14, wherein the first water nozzle points toward the direction of lanced insertion and the second water nozzle points toward the direction of lanced retraction.

18. The sootblower of claim 14, further comprising a control system configured to:

control the rotation and linear motion of the lance tube to apply a substantially constant progression of the first water stream as it contacts a planar face of a platen positioned perpendicular to the direction of linear motion of the lance as the lance is inserted into the boiler; and control the rotation and linear motion of the lance tube to apply a substantially constant progression of the second water stream as it contacts an opposing planar face of the platen as the lance is retracted from the boiler.

19. The sootblower of claim 14, wherein the control system comprises a strain gauge measuring the accumulation of ash deposits on an interior boiler component and automatically triggering operation of the sootblower to clean the component upon detection of a predetermined level of accumulation.

20. The sootblower of claim 14, wherein the control system comprises a camera viewing an interior boiler component and automatically discontinuing operation of the sootblower to clean a portion of the component upon detection of successful cleaning of the portion.

21. An automatic cleaning system for a power plant boiler, comprising:

boiler monitoring equipment for detecting an ash accumulation condition of the interior of the boiler;

boiler cleaning equipment for cleaning the interior of the boiler while the boiler is in operation comprising at least one multi-media rotating sootblower comprising a lance tube simultaneously carrying at least two separately controlled cleaning fluid applicators, the lance tube rotating as it delivers cleaning fluids through the separately controlled cleaning fluid applicators to clean the interior components of the boiler, and a drive system for linearly inserting the lance tube into and retracting the lance tube from the boiler while rotating the lance tube; and a control system configured to receive sensor data from the boiler monitoring equipment, determine the ash accumulation condition of the interior of the boiler based on the sensor data, and to generate control signals to automatically activate and control the boiler cleaning equipment in response to the ash accumulation condition including turning on or off each separately controlled cleaning fluid applicator without have to install a device on or remove a device from the lance tube.

22. The automatic cleaning system of claim 21, wherein:

the boiler monitoring equipment includes a system of strain gauges configured to measure the weight of accumulated ash deposits on hanging superheater platens within the boiler; and the control system activates the rotating multi-media rotating sootblower to clean a particular platen in response to strain gauge signals indicating a predetermined weight of accumulated ash deposits on the particular platen.

23. The automatic cleaning system of claim 22, wherein:

the boiler monitoring equipment includes a boiler camera configured to observe the condition of the particular platen during cleaning; and the control system deactivates the rotating multi-media rotating sootblower for cleaning a portion of the particular platen in response to camera data indicating that the portion of the particular platen has been successfully cleaned.

24. The automatic cleaning system of claim 23, wherein:

the boiler monitoring equipment includes heat transfer gauges configured to measure heat transfer in a furnace section of the boiler; and the control system activates water cannons to clean the furnace section of the boiler in response to heat transfer gauge data indicating that a predetermined drop in heat transfer has occurred within the furnace section.

25. The automatic cleaning system of claim 24, wherein:

the boiler monitoring equipment includes a furnace camera configured to observe the condition of the furnace during cleaning; and the control system deactivates the water cannon for cleaning a portion of the furnace section in response to camera data indicating that the portion of the furnace section has been successfully cleaned.

26. The automatic cleaning system of claim 25 further comprising single-media sootblowers for cleaning other sections of the boiler.

27. A power plant having a boiler with a thermal output rating, comprising:

an automatic cleaning system for the boiler configured to automatically clean the boiler to maintain the thermal output rating including;

boiler monitoring equipment for detecting the ash accumulation condition including turning on or off each separately controlled cleaning fluid applicator without have to install a device on or remove a device from the lance tube of the interior of the boiler, boiler cleaning equipment for cleaning the interior of the boiler while the boiler is in operation comprising at least one multi-media rotating sootblower comprising a lance tube simultaneously carrying at least two separately controlled cleaning fluid applicators, the lance tube rotating as it delivers cleaning fluids through the separately controlled cleaning fluid applicators to clean the interior components of the boiler, and a drive system for linearly inserting the lance tube into and retracting the lance tube from the boiler while rotating the lance tube; and a control system configured to receive sensor data from the boiler monitoring equipment, determine the ash accumulation condition of the interior of the boiler based on the sensor data, and to generate control signals to automatically activate the boiler cleaning equipment in response to the ash accumulation condition.

28. The automatic cleaning system of claim 27, wherein:

the boiler monitoring equipment includes a boiler camera configured to observe the condition of the particular platen during cleaning; and the control system deactivates the rotating multi-media rotating sootblower for cleaning a portion of the particular platen in response to camera data indicating that the portion of the particular platen has been successfully cleaned.

29. The automatic cleaning system of claim 28, wherein:

the boiler monitoring equipment includes heat transfer gauges configured to measure heat transfer in a furnace section of the boiler; and the control system activates water cannons to clean the furnace section of the boiler in response to heat transfer gauge data indicating a predetermined drop in heat transfer has occurred within the furnace section.

30. The automatic cleaning system of claim 29, wherein:

the boiler monitoring equipment includes a furnace camera configured to observe the condition of the furnace during cleaning; and the control system deactivates the water cannon for cleaning a portion of the furnace section in response to camera data indicating that the portion of the furnace section has been successfully cleaned.

31. The automatic cleaning system of claim 30 further comprising single-media sootblowers for cleaning other sections of the boiler.

32. A sootblower for cleaning internal components of an industrial boiler while the boiler is in operation, comprising:

a lance tube simultaneously carrying separately controlled steam and water applicators, the lance tube rotating as it selectively delivers stream to clean the interior components of the boiler;

a drive system for linearly inserting the lance tube into and retracing the lance tube from the boiler while rotating the lance tube;

a water distributor operative for delivering the water to the lance tube while the lance tube simultaneously receives the steam; and a control system for controlling the delivery of the water.

33. The sootblower of claim 32, wherein the lance tube moves telescopically while rotating on a steam tube that delivers the steam to the internal cavity of the lance tube.

34. The sootblower of claim 33, wherein the conduits receive the water while the internal cavity of the lance tube receives the steam.

35. A sootblower for cleaning internal components of an industrial boiler while the boiler is in operation, comprising:

a lance tube simultaneously carrying at least two separately controlled cleaning fluid applicators, the lance tube rotating as it delivers first and second separately controlled cleaning fluids to clean the interior components of the boiler;

a drive system for linearly inserting the lance tube into and the lance tube from the boiler while rotating the lance tube;

a cleaning fluid distributor operative for delivering the first cleaning fluid to the lance tube while the lance tube simultaneously receives the second cleaning fluid; and a control system for controlling the delivery of the first and second cleaning fluids.

36. A sootblower for cleaning internal components of an industrial boiler while the boiler is in operation, comprising:

a lance tube simultaneously carrying at least two separately controlled cleaning fluid applicators, the lance tube rotating as it delivers first and second separately controlled cleaning fluids to clean the interior components of the boiler:

a drive system for linearly inserting the lance tube into and retracting the lance tube from the boiler while rotating the lance tube; and a control system for remotely controlling the delivery of the first and second cleaning fluids.

* * * * *